US009527048B2

(12) United States Patent
Wittek

(10) Patent No.: US 9,527,048 B2
(45) Date of Patent: Dec. 27, 2016

(54) ROTOR-STATOR SYSTEM FOR THE PRODUCTION OF DISPERSIONS

(76) Inventor: Axel Wittek, Ottenbuettel (DE)

( * ) Notice: Subject to any disclaimer, the term of this patent is extended or adjusted under 35 U.S.C. 154(b) by 1403 days.

(21) Appl. No.: 12/990,963

(22) PCT Filed: Apr. 30, 2009

(86) PCT No.: PCT/EP2009/003157

§ 371 (c)(1),
(2), (4) Date: Jan. 3, 2011

(87) PCT Pub. No.: WO2009/135624

PCT Pub. Date: Nov. 12, 2009

(65) Prior Publication Data

US 2011/0158931 A1 Jun. 30, 2011

(30) Foreign Application Priority Data

May 6, 2008 (DE) ..... 10 2008 022 355

(51) Int. Cl.
*B01F 15/00* (2006.01)
*B01F 3/08* (2006.01)
(Continued)

(52) U.S. Cl.
CPC ..... *B01F 3/0807* (2013.01); *B01F 3/0865* (2013.01); *B01F 5/0684* (2013.01); *B01F 5/0688* (2013.01);
(Continued)

(58) Field of Classification Search
CPC ..... B01F 3/0807; B01F 7/00766
(Continued)

(56) References Cited

U.S. PATENT DOCUMENTS 1,711,154 A 4/1929 Jaroslav
3,806,050 A 4/1974 Cumpston, Jr.
(Continued)

FOREIGN PATENT DOCUMENTS

CH 671 524 A5 9/1989
DE 1105851 B 2/1962
(Continued)

OTHER PUBLICATIONS

Hausruf Wenger, "Related Office Action", Mar. 20, 2009, Published in: DE.
(Continued)

*Primary Examiner* — Tony G Soohoo
*Assistant Examiner* — Anshu Bhatia
(74) *Attorney, Agent, or Firm* — Kaplan Breyer Schwarz & Ottesen, LLP

(57) ABSTRACT

A rotor-stator system with which stable dispersions can be produced in one single cycle and can be flexibly adjusted to changing requirements to the composition of the dispersion. A stator for a rotor-stator system provided with a dispersion zone, wherein a rotor corresponding with the stator defines a dispersion chamber, and with an inlet for feeding a first component of a dispersion into the dispersion zone, the inside of the stator accommodating a premixing chamber outside the dispersion zone, said premixing chamber opening into the dispersion zone, and the stator having an intake for feeding an additional component of the dispersion from outside the stator into the premixing chamber, and during operation of the stator, components of the dispersion enter the premixing chamber from the dispersion zone and from the intake, are mixed in said premixing chamber and exit from said premixing chamber into the dispersion zone.

20 Claims, 23 Drawing Sheets

(51) Int. Cl.

| | |
|---|---|
| ***B01F 5/06*** | (2006.01) |
| ***B01F 7/00*** | (2006.01) |
| ***B01F 15/02*** | (2006.01) |
| *B01F 7/16* | (2006.01) |
| *B01F 5/00* | (2006.01) |

(52) U.S. Cl.
CPC ..... *B01F 7/00766* (2013.01); *B01F 15/0201* (2013.01); *B01F 7/16* (2013.01); *B01F 2005/0011* (2013.01)

(58) Field of Classification Search
USPC ..... 366/178.2, 172.1, 303, 315, 171.1
See application file for complete search history.

(56) References Cited

U.S. PATENT DOCUMENTS

| | | | | |
|---|---|---|---|---|
| 4,155,658 | A | 5/1979 | Doom | |
| 5,467,931 | A | 11/1995 | Dodd | |
| 5,590,961 | A | 1/1997 | Rasmussen | |
| 5,931,579 | A * | 8/1999 | Gallus et al. | 366/163.2 |
| 6,386,751 | B1 * | 5/2002 | Wootan | A01K 63/042 366/170.3 |
| 2001/0021372 | A1 | 9/2001 | Omtveit et al. | |
| 2009/0175121 | A1 * | 7/2009 | Rausch et al. | 366/160.1 |

FOREIGN PATENT DOCUMENTS

| | | | |
|---|---|---|---|
| DE | 3202915 | A1 | 8/1983 |
| DE | 200 09 105 | U1 | 8/2000 |
| EP | 0374201 | | 6/1990 |
| EP | 0 778 370 | A1 | 6/1997 |
| EP | 0 830 894 | A1 | 3/1998 |
| EP | 1 121 974 | A1 | 8/2001 |
| GB | 1 566 753 | A | 5/1980 |
| JP | 02-144136 | A | 6/1990 |
| WO | 9622830 | A1 | 8/1996 |
| WO | 0001474 | A1 | 1/2000 |

OTHER PUBLICATIONS

Krasenbrink, B., "International Search Report for International Application No. PCT/EP2009/003157", 03-02-210, Publisher: European Patent Office, Published in: EP.

International Searching Authority, "Written Opinion of the International Searching Authority", , Publisher: PCT, Published in: EP.

* cited by examiner

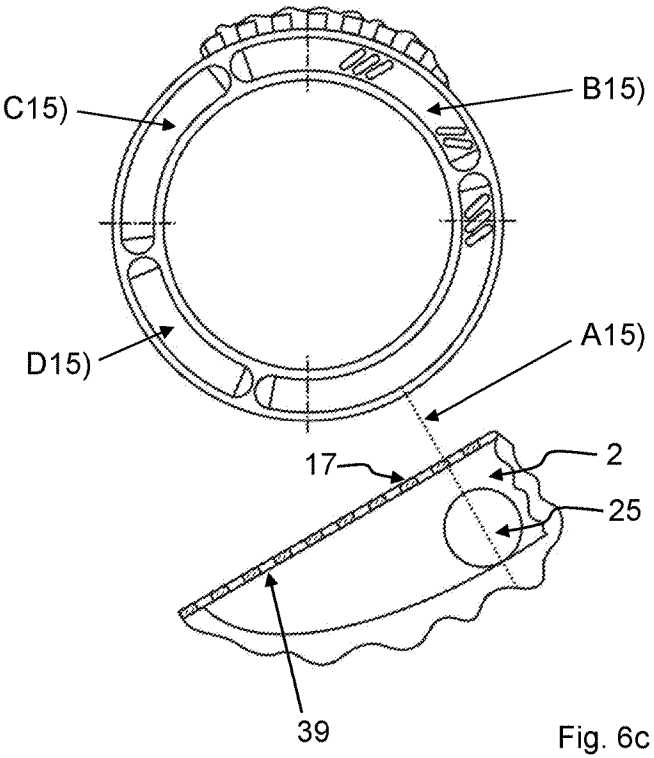
Fig. 6c
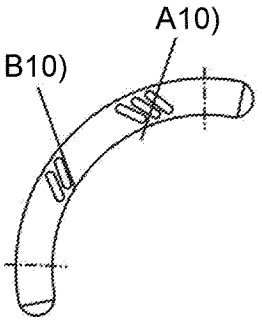
Fig. 6a
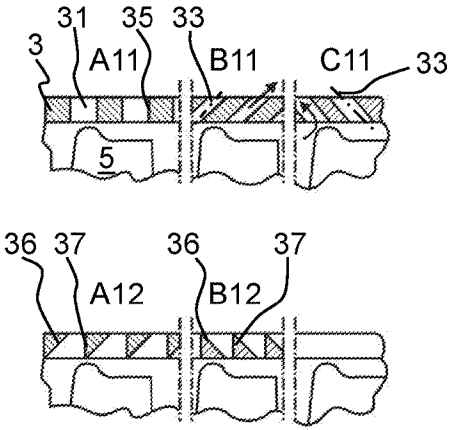
Fig. 6b
Fig. 6

ROTOR-STATOR SYSTEM FOR THE PRODUCTION OF DISPERSIONS

FIELD OF INVENTION

The invention relates to a stator and a rotor for a rotor-stator system, and to a method for the production and/or treatment of dispersions. The invention relates to the production and/or treatment of dispersions in general, and of emulsions in particular.

BACKGROUND OF THE INVENTION

The term "dispersion" is understood to relate to a multiphase system, which at least consists of components that are essentially not soluble in one another. Dispersions comprise in particular emulsions, in which one liquid is distributed in the form of droplets in another liquid. The phase forming the droplets is referred to as the disperse phase or inner phase. The phase in which the droplets are distributed is referred to as the continuous phase or outer phase.

Dispersions furthermore comprise suspensions in which solid particles are dispersed in a liquid continuous phase. Material systems in which both solid and liquid phases are present in a dispersed form are also counted among dispersions. A solid could, for instance, be present in a distributed form in a first liquid, while this suspension forms the disperse phase of an emulsion. Solids can also be distributed in the continuous phase of emulsions. These may in this context also be referred to as suspo-emulsions.

If two liquids that are essentially not soluble in one another are mixed with each other so that both phases are accessible, material system thus produced is referred to as a mixture. A mixture can be diluted by adding either the one or the other phase. In an emulsion, the disperse phase is, by contrast, not accessible from outside; an emulsion can only be diluted by adding the continuous phase. In producing an emulsion, a mixture can occur as an intermediate stage.

The term "component" will be used herein below to describe in particular one phase of a dispersion. A component may, however, also be a constituent of a phase. A phase can, for instance, be formed by several components that are in particular soluble in one another.

When producing dispersions in particular in the production of emulsions, it is important that the steps required for introducing the inner phase into the outer phase for the production of a premix, and for fine dispersion and stabilization of the product thus obtained, are reliably performed in a defined process, in order to produce a final product with the intended characteristics respecting size distribution of the disperse phase, and flow properties and stability of the product in the presence of thermal and mechanical loads and changes over time. A similar process known from private cooking practice is the production of mayonnaise. The oil phase is gradually stirred into the water phase. This first of all generates a coarse and low-viscosity emulsion as a premix. Continued and quick stirring then produces a finer emulsion, and the viscosity increases. A number of different processes are available for industrial-scale production of dispersions, and in particular emulsions. Which of these processes is used depends on the type of dispersion, and on the fineness of the disperse phase, which can generate a dispersion that is stable for the required period of time. A stable dispersion is understood to be a material system, in which the particle size distribution of the disperse phase and/or the flow properties of which, in particular the viscosity of which, do not change in any essential manner during the defined period.

For the industrial-scale production of dispersions, vessels equipped with a stirrer, for instance a scraper stirrer or a stirrer turbine, are often used for relatively coarse dispersions. For finer dispersions, two-stage processes are used, in which first a premix is produced in a stirred tank, after which the premix is passed through a rotor-stator dispersing machine. This machine could, for instance, be a colloid mill. Very fine dispersions can be produced with a dispersion process in a high-pressure homogenizer as an additional step.

When using a premix having been mixed in a stirred vessel for the production of a fine dispersion in a rotor-stator system, the dispersion is usually assumed to have a very wide particle size distribution. The example to be considered here is an emulsion with a droplet size distribution between 30 and 500 μm. In a conventional rotor-stator system (cf. FIG. 11; see description below), the droplets of the premix, which in the case of an emulsion may also be referred to as a raw emulsion, are reduced in size until a mean droplet size has been reached that corresponds to the specific energy input of the rotor-stator system (energy density). For a relatively narrow droplet size distribution with droplet diameters between 5 and 10 μm and below, it will normally be necessary to run several rotor-stator system passes. Often as many as 5 to 10 passes are necessary. This, on the one hand, exposes the product to considerable mechanical stresses, while the high thermal input, on the other hand, does not permit the energy supplied to be utilized efficiently.

In order to accelerate the process described above, some manufacturers of dispersing machines have started to apply the inner phase directly in front of the rotor teeth or to the rotor teeth of a rotor-stator system, using such means as pipes or boreholes. These rotor-stator systems are described in WO 00/01474 and U.S. Pat. No. 5,590,961. In these systems, the inner phase enters the rotor-stator system and its dispersion zone within a rather limited region and hence in a relatively compact jet. During the first pass through the rotor-stator system, an emulsion is thus produced that is characterized by a wide droplet size distribution, because the inner phase cannot be sufficiently finely blended into the outer phase, which is due to the fact that the spatial limitation does not make a sufficiently large exchange surface available for contact. The droplets in the emulsion, in addition, tend to coalesce, because many small droplets are formed within a small volume so that they cannot be separated and stabilized quickly enough. Another consequence observed in this context is the formation of schlieren. The larger the volume of inner phase added, the more distinct are the coalescence and schlieren effects. In this way, small amounts of the inner phase can be fed into the outer phase. When larger amounts of the inner phase have to be applied, this can produce considerable problems. These problems result from the fact that it is not possible to produce a homogeneous raw emulsion, or a homogeneous premix, with a definable particle size distribution from the outer and the inner phases, before the phases enter the zones of high shear forces in the rotor-stator system.

WO 01/56687 (PCT/EP00/117700) describes a rotor-stator system whose rotor comprises a premixing chamber. The premixing chamber opens into several small chambers on the circumference of the rotor. All the chambers together act as one premixing chamber in the rotor, which is accommodated in the dispersion compartment and which rotates when the rotor-stator system is in operation. Because of the rotor geometry and the volume which is thus available as a premixing chamber, the amount of the inner phase that can be introduced into the outer phase is rather limited. Since the premixing chamber is located in the rotor, and thus in a section of the rotor-stator system which is in motion, the production of dispersions with complex composition and different components, some of which have to be simultaneously introduced into an existing mixture, becomes a very complicated, if not impossible, process.

SUMMARY OF THE INVENTION

The object of the invention is hence to provide a structurally simple possibility of producing stable dispersions in a rotor-stator system even after one single cycle. Another object of the invention is to provide a possibility to flexibly respond with a rotor-stator system to changing requirements respecting the composition of the dispersion to be produced. It is, furthermore, the object of the invention to provide a rotor-stator system which is in the position to create a plurality of high-energy vortices in a turbulent flow so that particles of the disperse phase of a dispersion can be efficiently reduced in size.

These tasks are solved in a surprisingly simple manner, with a stator for a rotor-stator system according to claim 1.

The subject invention provides a stator for a rotor-stator system for the production and/or treatment of dispersions with a dispersion zone, which, with a rotor corresponding with the stator, defines a dispersion compartment of the rotor-stator system, and with an inlet for feeding a first component of a dispersion into the dispersion zone, the inside of the stator accommodating at least one premixing chamber outside the dispersion zone which opens into the dispersion zone, the stator having at least one intake for feeding an additional component of the dispersion from outside the stator into the premixing chamber, and the stator being designed such that, during operation of the stator, components of the dispersion enter the premixing chamber from the dispersion zone and from the intake, are mixed with one another in said premixing chamber, and exit from said premixing chamber into the dispersion zone.

In a development of the invention, the stator has at least two premixing chambers, each providing one intake for feeding a component of the dispersion from outside the stator into the relevant premixing chamber. Different components can thus either be added through each premixing chamber. Or a large amount of one component can be distributed over several premixing chambers for application. In either case, the efficiency of the mixing process is enhanced in comparison with a system in which the components are directly fed into the dispersion compartment.

According to another advantageous design version, the premixing chamber curves into the stator from the transition to the dispersion zone. This curved design provides for easy and reliable cleaning of the premixing chamber. It also prevents the formation of dead spots that can have an adverse influence on the mixing effect in the premixing chamber.

According to the invention, the premixing chamber can have the shape of a strip-like section of a circle segment at the transition to the dispersion zone, this section, in particular, having a continuously curved circumferential line. This design, too, prevents corners from being formed, one effect of which is that cleaning is facilitated.

The invention, furthermore, offers the advantage that with the position of the premixing chambers, dispersion flow into the dispersion zone can be adjusted to the given process conditions. In a development of the invention, the transition between the premixing chamber and the dispersion zone is to be provided at such a radial distance from the longitudinal axis of the stator, which is identical with the axis of rotation of the rotor corresponding with the stator, that the premixing chamber is positioned above a dispersion tool, in particular a rotor tooth ring, when the stator is combined with the corresponding rotor to form a rotor-stator system. The premixing chambers can hence be positioned above the tooth ring of a rotor which is provided with one tooth ring.

In a rotor provided with more than one tooth ring, a premixing chamber can be arranged above the inner tooth ring, above the outer tooth ring, or across several tooth rings. The transition of the premixing chamber to the dispersion zone is accordingly positioned at such a radial distance from the longitudinal axis of the stator, which is identical with the axis of rotation of the rotor corresponding with the stator, that the premixing chamber is positioned at least above the inner dispersion tool, in particular the inner tooth ring, of a rotor with more than one dispersion tools, when the stator is combined with the corresponding rotor to form the rotor-stator system.

In an advantageous development, the invention, in addition, provides a stator, which has premixing chambers that are positioned at different radial distances from the longitudinal axis of the stator. This, for instance, creates a stator for use in conjunction with a rotor which has at least one inner and one outer tooth ring, at least one premixing chamber being positioned above the inner tooth ring of the rotor, and at least one additional premixing chamber above the outer tooth ring of the rotor, when the stator is used in conjunction with the rotor.

If premixing chambers are provided both above the inner rotor tooth ring and above rotor tooth rings positioned further to the outside, media with a relatively high viscosity can be applied on the inside and media with a relatively low viscosity on the outside, during one single pass through the rotor-stator system. This offers advantages when, for instance, dispersing low-viscosity media, such as perfumes or preservatives on the one hand, and when dispersing fluids of a higher viscosity and/or larger resultant droplet sizes, on the other.

Fluids added through the premixing chambers positioned closer to the central axis will, with otherwise identical parameters, in particular identical fluid flow behaviour, normally be dispersed to smaller droplets than fluids added through premixing chambers further to the outside, because they have to travel a longer distance through the dispersion compartment. Fluids added on the inside are thus exposed to the dispersing action of the rotor-stator system for a longer period of time.

In order to be able to additionally affect the flow conditions at the transition between premixing chamber and dispersion compartment, a transition piece is arranged in accordance with an advantageous development of the invention between the premixing chamber and the dispersion zone. With the rotor-stator system in operation, fluid is injected from the premixing chamber into the dispersion compartment and it is ejected from the dispersion compartment into the premixing chamber. Hereinbelow, the transition piece will also be referred to as injector or as ejector. Depending on the actual application, the transition piece can take up part of, or the complete area of the transition between the premixing chamber and the dispersion zone.

For compliance with the advantageous geometry of the premixing chamber, the transition piece in one embodiment of the invention has the shape of a strip-like section of a circle segment. In that case, the circumferential line of the transition piece can be curved so that it exactly matches the shape of the premixing chamber at the transition to the dispersion compartment.

For particularly thorough mixing of the liquid at the transition between premixing chamber and dispersion compartment, the transition piece is, furthermore, to be designed like a perforated plate providing one or a plurality of circular and/or polygonous openings, and/or a slot or a plurality of slots as holes, several slots preferably being essentially arranged at right angles with the main direction of expansion of the transition piece.

Flow conditions in the vicinity of the transition piece can, furthermore, be affected by the orientation of the holes in the transition piece. In another embodiment of the invention, the holes passing through the transition piece are arranged along a hole axis, which together with the line perpendicular to the transition piece forms an angle, in particular an angle within the range between about 10° and about 80°, preferably within the range between about 30° and about 60°, and especially preferably an angle of about 45°.

The holes passing through the transition piece can, in addition, be designed to taper from one side of the transition piece to the other in order to increase the injector and ejector effect. The invention, in particular, provides that the holes are delimited by a lateral area with a first partial area and at least one additional partial area, at least one partial area running along an intersecting plane, which together with the line perpendicular to the transition piece forms an angle, in particular an angle within the range between about 10° and about 80°, preferably within the range between about 30° and about 60°, and especially preferably an angle of about 45°.

In order to design the inventive stator so that it allows the rotor-stator system to be flexibly adapted to different dispersion requirements in a simple manner, the invention furthermore provides for a two-part stator design. The stator then comprises a stator head as well as a stator body, with at least one premixing chamber being arranged in the stator head, and the stator body comprising one dispersion tool of the stator, in particular at least one tooth ring.

In this manner a stator can, for instance, be created that can be used for retrofitting existing rotor-stator systems. Such a stator comprises several stator heads that differ in the number and/or geometry of the premixing chambers and that can be mounted on a stator body in order to form a stator with replaceable stator head.

A particularly simple configuration will be implemented by designing the premixing chamber as a cavity in the stator head such that a transition piece can be fitted to the stator head so that it delimits the cavity.

The invention thus also relates to a stator head for a stator as described above, which is suited for retrofitting conventional stators. The invention, furthermore, relates to a transition piece as described above.

The invention, furthermore, relates to the use of a stator or stator head described above as a housing component of a pump, in particular of a single- or multi-stage centrifugal pump, or of a stirrer, in particular when operated with a propeller stirrer or a disk stirrer, or of a dispersion unit. The component of the apparatus, which comprises the premixing chamber, forms in its mounted state an integral part of the housing.

The invention also provides a rotor, in particular for use in conjunction with a stator as described above, for a rotor-stator system for the production and/or treatment of dispersions, with a carrier disk arranged rotationally symmetrically with the central axis of the rotor, with at least one rotor tooth having its source in said disk, the rotor tooth having an inner side facing the central axis, an outer side facing the outer rim of the carrier disk, a front side positioned at the front end of the rotor as seen in its direction of rotation when in operation, a rear side positioned at the rear end of the rotor as seen in its direction of rotation when in operation, and a top side delimiting the rotor tooth on the side facing away from the carrier disk, the front side comprising at least one bottom area facing the carrier disk, which is inclined to the rear from the line perpendicular to the carrier disk by an angle of $\alpha_4$ (alpha-4) in relation to the direction of rotation of the rotor when in operation. According to the invention, the angle $\alpha_4$ is in the range between 0° and about 45°, preferably between about 15° and about 45°.

With the rotor-stator system in operation, the inclination by angle $\alpha_4$ produces a fluid flow in the vicinity of the rotor tooth, which is directed towards the stator. The medium to be dispersed is conveyed against the stator in the dispersion compartment. This produces forces, which, for instance in the production of emulsions, contribute to a comminution of the droplets in the disperse phase. If a stator as described above is used with a premixing chamber, this flow directed against the stator intensifies the process of fluid injection from the dispersion compartment into the premixing chamber, and thus provides for excellent mixing of the components of the dispersion and possibly comminution of the droplets in the disperse phase.

An advantageous development of the rotor in accordance with the subject invention provides that the front side comprises at least one area which is inclined to the rear from a reference line running radially outwards from the central axis by angle $\alpha_6$ (alpha 6), related to the direction of rotation of the rotor when in operation. With the rotor in operation, the radial acceleration of the fluid away from the axis of rotation can thus be intensified, which contributes to an improved mixing and possibly comminuting effect of the rotor-stator system. According to the invention, angle $\alpha_6$ is between about 0° and about 60°, preferably between about 10° and about 60°.

The invention also provides the possibility that the front side comprises at least one top area pointing away from the carrier disk, which, in relation to the line parallel to the main area of expansion of the carrier disk, is inclined towards the carrier disk by an angle $\alpha_5$ (alpha 5). According to the invention, angle $\alpha_5$ is between about 5° and about 45°.

The line parallel to the carrier disk corresponds to the line perpendicular to the central axis, which is the same as the axis of rotation of the rotor. The inclination by angle $\alpha_5$ intensifies the effect of the inclination by angle $\alpha_4$. With the inclination by angle $\alpha_5$ it is, in particular, possible to create or intensify a flow component, referred as "jet stream". This flow component will be dealt with in further detail below, in connection with the embodiments.

When using the rotor-stator system for emulsifying functions, the efficiency of droplet comminution depends on several factors, including the kinetic energy fed into the fluid in the dispersion compartment, the generated turbulence vortices, and the density of the turbulence. For purposes of the subject invention, the turbulence vortices are generated with a rotor-stator system. In this connection the edge length of the rotor and/or stator teeth, which generate the vortices, play an important role. The longer the effective edge length of a tooth, the more effective the system.

With the invention, a novel form of teeth is made available, which generate turbulence vortices with a very high kinetic energy and which, in addition, whirl the fluid itself in a three-dimensional manner. Thus, a rotor-stator system is provided which is in the position to generate a large number of high-energy vortices in a turbulent flow, in order to efficiently comminute particles of the disperse phase in a dispersion. Turbulence is understood to be a "chaotic" type of flow, which is instationary both in respect of time and space. Turbulence is characterized by statistic fluctuations of the fluid flow velocity and the fluid flow direction, and it can be described with the aid of Kolgomorov's theory.

Each individual rotor tooth is designed so that the fluid flow generated has a high radial component, which is produced by angle $\alpha_6$ and which is directed through the dispersion compartment towards the outlet duct, and a vertical component directed upwards (see FIGS. 18 and 12), which is the result of the shape produced with angles $\alpha_4$ and $\alpha_5$.

The radial component is determined by the pitch angle $\alpha_6$ of the rotor teeth and the circumferential velocity, and the higher these angles, the larger the throughput with the same stator geometry. As a result of the backward inclination of the rotor teeth ($\alpha_4$) and the vertical teeth of the stator, intensive micro-turbulence vortices are created at the dispersing edges (FIG. 18, turbulence I), which is the case at outside rotor diameters within a range of 50 to about 300 mm, in particular at a circumferential velocity above 22 m/s (Reynolds number Re not less than 10,000).

Since the inclined rotor teeth close the gaps between the straight stator teeth, a three-dimensional fluid vortex is created in the dispersion compartment. As the energy level of the turbulent vortices increases from the inside to the outside of the dispersion compartment, the droplets can be comminuted more and more when the emulsion essentially passes the dispersion compartment from the inside to the outside.

Increasing pressure from the inside to the outside, in addition, produces turbulences of a higher energy level towards the outer edge of the dispersion compartment. This increase in pressure results from the fact that the area through which the fluid passes at the inner tooth ring of the stator is larger than at the outer tooth ring of the stator (see FIG. 9 top).

The vertical component of the rotor creates pressure towards the stator top housing. Because of the vertical component, the fluid is forced through the gap between the stator top housing and the rotor tooth, thus generating the jet stream (FIG. 18) with an energy content which is the higher, the higher the circumferential velocity or the Reynolds number. As is, for instance, evident from FIG. 12, the front part of the rotor teeth has an angle $\alpha_4$ in a clockwise direction. This angle, which can for this purpose preferably be between about 15° and about 45°, generates the vertical component as well as the micro turbulences with the stator teeth.

The top part of the teeth is designed so that the fluid is accelerated between the teeth with angle $\alpha_5$ and the stator top housing, and then very suddenly reaches a low-pressure region so that a high-energy turbulence is created, referred to as jet stream for these purposes (cf. the milled region described in connection with FIG. 12; see also FIG. 18). Angle $\alpha_5$ can, for this purposes, preferably be between about 5° and about 45°. Based on a model conception, the function of the tooth geometry according to the invention thus corresponds to that of an injector or a nozzle.

With this novel configuration of the invention, using the width of the tooth for the formation of at least one additional, defined dispersion edge, the dispersion edge length is increased by up to 35% in comparison with conventional rotor-stator systems (see FIG. 11). Unlike known dispersion machines (see FIG. 11), in which the rotor and stator teeth are straight, the invention uses the potential of micro turbulences for droplet comminution.

The same effects will also be produced when the rotor teeth remain straight, and the stator teeth are inclined at an angle. The invention hence generally relates to a rotor-stator system, in which an angle, preferably in the range between about 10° and about 45°, is formed between the dispersion edges of a rotor tooth and a stator tooth interacting with the rotor tooth, when rotor and stator engage, and the rotor tooth and the stator tooth are positioned adjacent to each other. The invention hence also relates to a stator for a rotor-stator system, whose teeth are designed in the same manner as described with the exampled used above for the rotor teeth.

The majority of known rotors have a rotor which is almost completely fitted with teeth. However, it has been demonstrated that this is not necessary for an advantageous effect of the invention. A satisfactory dispersion effect respecting component mixing and comminution of the disperse phase will already be achieved when the rotor has a first tooth ring with at least two, preferably four, rotor teeth, having a first radial distance $d_1$ from the central axis of the rotor, and preferably being uniformly spaced from each other.

According to the invention, the rotor can be developed so that it is equipped with a second tooth ring for intensified dispersion action. The second tooth ring has at least two, preferably four, especially preferably eight, rotor teeth, which have a second radial distance $d_2$ from the central axis of the rotor, and which are preferably uniformly spaced from each other, $d_2$ being larger than $d_1$.

The invention, furthermore, concerns a method for the production and/or treatment of dispersions, using a rotor-stator system with a stator as described above, and with the following steps a) provision of a first phase of the dispersion in a first receiving tank, which communicates with the dispersion compartment, and provision of at least one second phase of the dispersion in at least one second receiving tank, which communicates with a premixing chamber,
b) feeding the first phase of the dispersion into the dispersion compartment,
c) feeding the second phase of the dispersion into the premixing chamber,
d) driving the rotor so that, with the rotor-stator system in operation, the first phase passes the dispersion compartment, and, if provided, the transition piece, and enters the premixing chamber, thus getting into contact with the second phase, and thus forming a mixture and/or a dispersion from the first and the second phase, and that the second phase and/or the mixture formed from the first and the second phase and/or the dispersion formed in the premixing chamber from the first and the second phase, is conveyed through the premixing chamber, and, if provided, the transition piece, into the dispersion compartment.

With the method according to the invention it is possible to add at least one phase or a component of a dispersion in the premixing chamber with a volume which is small in comparison with the dispersion compartment. The dispersion compartment is thus fed with a component premix, in which the components of the premix are already present in a homogeneously distributed form.

According to the invention, the throughput of the components and the speed of the rotor can in an advantageous manner be adjusted and/or controlled so that the retention time in a premixing chamber will be within a range of about 0.005 seconds and about 0.02 seconds. With the premix formed within this short period of time and passed on into the dispersion compartment, coalescence of the disperse-phase fluid elements, which are formed in the premixing chamber, can be counteracted.

According to an advantageous development of the method, a stator with at least one additional premixing chamber is used, and in step a) at least one additional phase of the dispersion is made available in at least one additional receiving tank, which communicates with the additional premixing chamber. In step c) the additional phase of the dispersion is fed into the additional premixing chamber of the rotor-stator system so that, with the rotor-stator system in operation, the first phase passes the dispersion compartment and, if provided, the transition piece, enters the premixing chambers, and gets into contact with the second or additional phase in the respective premixing chamber, thus forming a mixture and/or a dispersion from the different phases, and the second or at least one additional phase and/or the mixture and/or the dispersion formed in one premixing chamber from at least two phases, being conveyed through the respective premixing chamber and, if provided, the respective transition piece before getting into the dispersion compartment.

Since several spatially separated premixing chambers are used for adding the feed material, the premixing chambers can be operated in parallel. In addition to that, the different components can be separately subjected to a premixing process before they are fed into the dispersion compartment. By distributing the addition of components across premixing chambers and thus breaking down the mixing process of all components of the dispersion, the mixing process according to the subject invention is improved in comparison with known methods.

In one version of the process, steps b), c) and d) are performed simultaneously. The process can thus be performed as a continuous process.

When, in particular, for the production of dispersions with a high disperse-phase percentage of more than 50% by volume, the larger disperse-phase volume is introduced into the smaller continuous-phase volume, the method according to the subject invention offers the advantage of being able to produce highly homogenous dispersions even when the disperse-phase percentage is high, by adding the disperse phase as a first phase added in step b), and adding the continuous phase, or an element of the continuous phase of the dispersion, as a second phase added in step c), and by including a phase inversion in producing the dispersion by dispersion as a result of the mixing and comminution effect of the rotor-stator system on the one hand, and an additional restructuring of the fluid elements as a result of phase inversion, on the other.

When compared with dispersions produced without phase inversion, these dispersions are characterized by a narrower particle size spectrum. This offers considerable advantages, in particular, when producing dispersions with a high disperse-phase percentage, since because of the high density of the particles, in particular droplets (in the case of emulsions), of the disperse phase, there is a high risk of coalescence. Coalescence nullifies the mixing effect and comminution of the disperse phase. The advantages of phase inversion can, however, also be utilized for dispersions with a low disperse-phase percentage.

In order to utilize the advantages of the flow pattern in the dispersion compartment and into the premixing chamber, a rotor as described above is used as a rotor of the rotor-stator system in a developed version of the process.

BRIEF DESCRIPTION OF THE DRAWINGS

Embodiments of the invention are described hereinbelow with reference to the attached drawings. All drawings use the same indicators for identification of the same elements. The figures show:

FIG. 1 the rotor-stator system according to a first embodiment of the invention, installed in a dispersion machine, as a cross-sectional view, FIG. 2 detail of a photograph of an inventive stator head, the detail showing a premixing chamber, FIG. 3 photograph of a transition piece according to a first embodiment of the invention, in which the transition piece has been placed on a sheet illustrating the geometry of a rotor tooth, FIG. 4 photograph of a transition piece according to a second embodiment of the invention, in which the transition piece has been placed on a sheet illustrating the geometry of a rotor tooth, FIG. 5 photograph of an inventive stator head with a premixing chamber, which has a transition piece welded to it where premixing chamber and dispersion zone come together, in the completely assembled state of the stator head, FIG. 6 various configurations of transition pieces according to the invention, in which FIG. 6*a* is a top view of a transition piece with schematically indicated geometries for the arrangement of slots B10) and A10), FIG. 6*b* represents details of cross sections through transition pieces according to further embodiments of the invention, each with a broken-out section of a rotor tooth for better illustration, with different hole configurations in the transition piece A11, B11, C11, A12 and B12, and FIG. 6*c* is a plan view of the transition between premixing chambers according to different embodiments of the invention and the dispersion compartment of the rotor-stator system, for which teeth of the inner rotor ring are schematically outlined at the top. Geometries A15, B15, C15 and D15 illustrate the size of the premixing chamber and the configuration of transition pieces (A15, B15), how they can be combined with each other or be used as an alternative. For orientation, FIG. 6*c* on the bottom right, shows a schematic section through a premixing chamber.

FIG. 10, bottom) as a cross-sectional and top view (left in FIG. 13), with an enlarged detail of a rotor tooth as a cross-sectional view (top right in FIG. 13), FIG. 14 a rotor according to another embodiment of the invention (cf. FIG. 10, bottom) as a cross-sectional and top view (left in FIG. 14), with an enlarged detail of a rotor tooth as a cross-sectional view (top right in FIG. 14), FIG. 15 a rotor according to one embodiment of the invention (cf. FIG. 10, bottom) as a cross-sectional and top view (left in FIG. 15), with an enlarged detail of a rotor tooth as a cross-sectional view (top right in FIG. 15), FIG. 16 a rotor according to another embodiment of the invention (cf. FIG. 10, bottom) as a cross-sectional and top view (left in FIG. 16), with an enlarged detail of a rotor tooth as a cross-sectional view (top right in FIG. 16), FIG. 17 sectional views of additional embodiments for rotor teeth according to the invention, FIG. 18 schematic representation to illustrate a model concept for the passage of an emulsion through the dispersion compartment of an inventive rotor-stator system, FIG. 19 schematic representation of a model concept for the production of an emulsion, during one cycle of an inventive rotor-stator system, FIG. 20 schematic representation of a model concept for a "bakers map,"

DETAILED DESCRIPTION

Figure 1:
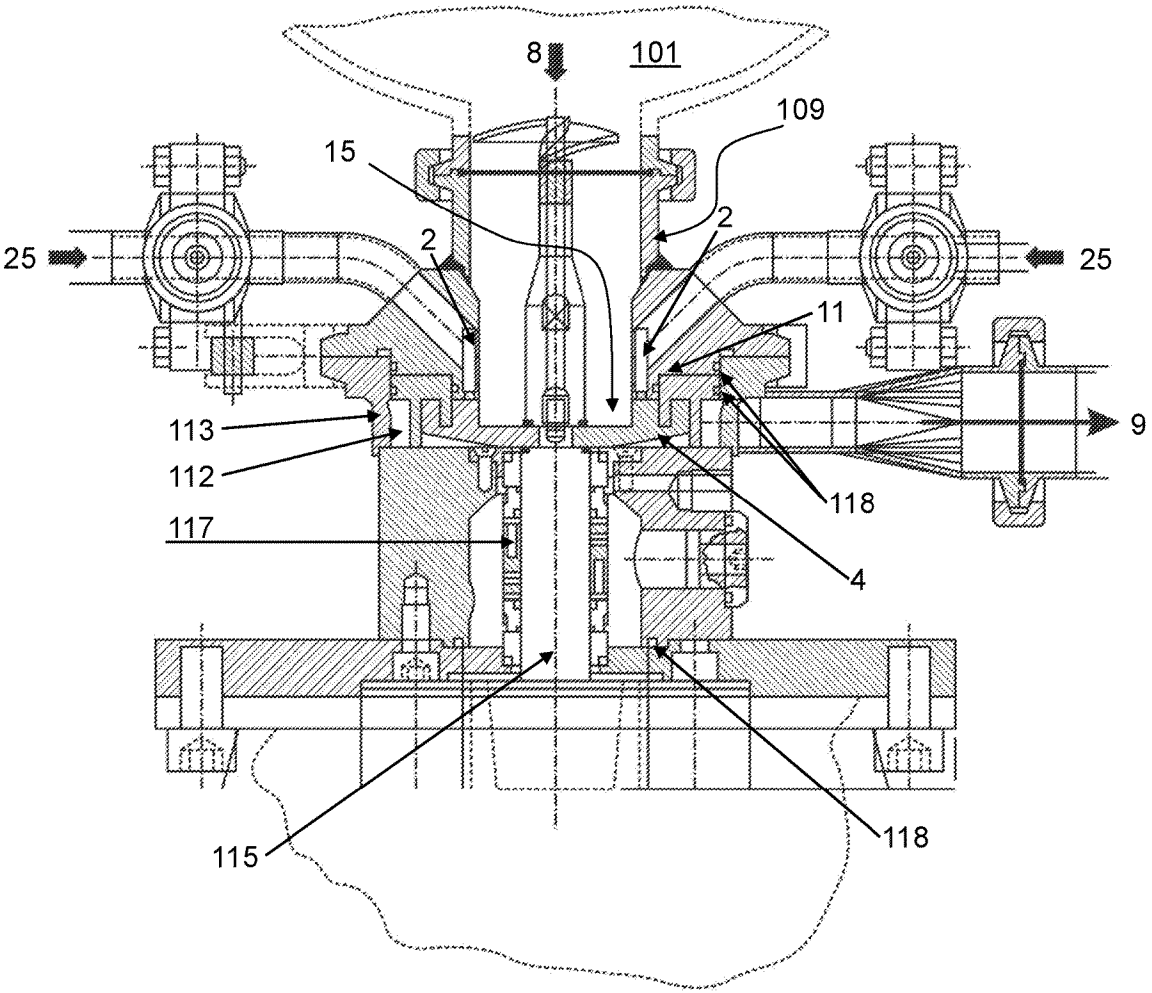

FIG. 1 is an overall view of a dispersion machine with an inventive rotor-stator system. In a first receiving tank 101, a first phase of a dispersion, which is to be produced, can be made available. Through inlet 8, this phase can enter the dispersion compartment of the rotor-stator system, which is formed by rotor 4 and stator 1. Through intakes 25, an additional phase of the dispersion can be passed into premixing chambers 2, which are housed in head 11 of the stator. FIG. 1 shows a rotor-stator system with two premixing chambers. Through the intakes 25, either half of the complete second phase to be added can be fed into each of the two premixing chambers 2, or different components can be fed into the dispersion to be produced, simultaneously and yet separate from each other, through one intake 25 and one premixing chamber 2 each.

The rotor 4 can be driven by a motor 116 via the drive shaft 115. The teeth of the rotor 4 then rotate past the teeth of the stator and below the transition between the premixing chambers 2 and the dispersion compartment of the rotor-stator system. With the rotor-stator system in operation, the dispersion is thus exposed to actions, including shear action, both in the dispersion compartment and in the premixing chambers, and also at the transition between the premixing chambers and the dispersion compartment. In addition, turbulent flow conditions are at least partly generated. While passing the premixing chamber, the transition between premixing chamber and dispersion compartment, and the dispersion compartment itself, the disperse phase of the dispersion is comminuted.

The dispersion compartment is surrounded on its outside by a ring duct 112, which is delimited by the housing 113 of the dispersion machine. From the ring duct 112, the dispersion can be extracted through an outlet 9 from the dispersion compartment.

Seals 117 and 118, which can be designed as mechanical seals, that is as rotating mechanical face seals or as static seals, that is, for instance, as O-ring seals, separate the dispersion compartment from the other driven or moved components of the dispersion machine.

Figure 2:
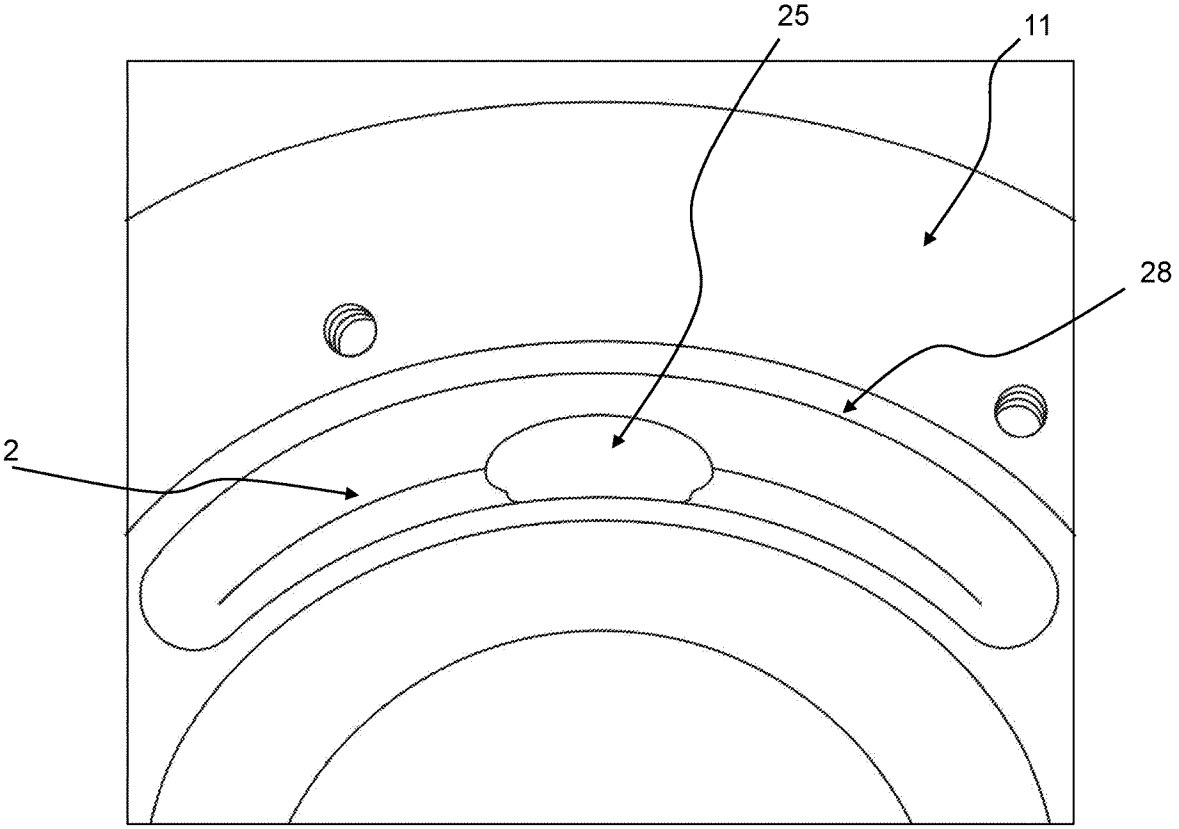

FIG. 2 is a view of the inside of a premixing chamber 2, seen from below from the dispersion compartment. The premixing chamber 2 is designed as a cavity inside the stator head 11. The premixing chamber 2 has a curved circumferential line 28. The premixing chamber 2 is designed to curve into the stator head 11. This means that the premixing chamber 2 is shaped so that there are essentially no corners and edges. This provides for very especially easy and reliable cleaning of the premixing chamber.

FIG. 2, in addition, shows the intake 25, through which a second phase can be fed into the premixing chamber. The first phase can enter through the premixing chamber and the transition, which is delimited by the circumferential line 28, from the premixing chamber to the dispersion compartment (not shown). No transition piece has been mounted at the transition between premixing chamber 2 and the dispersion compartment of the rotor-stator system shown in FIG. 2.

Figure 3:
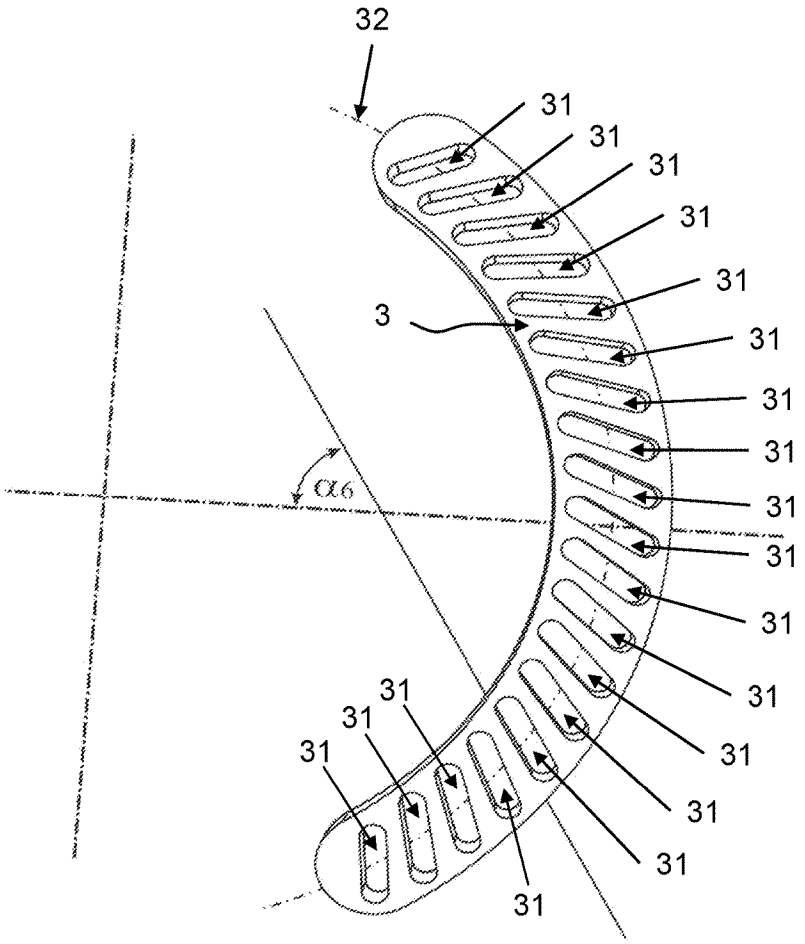
Figure 4:
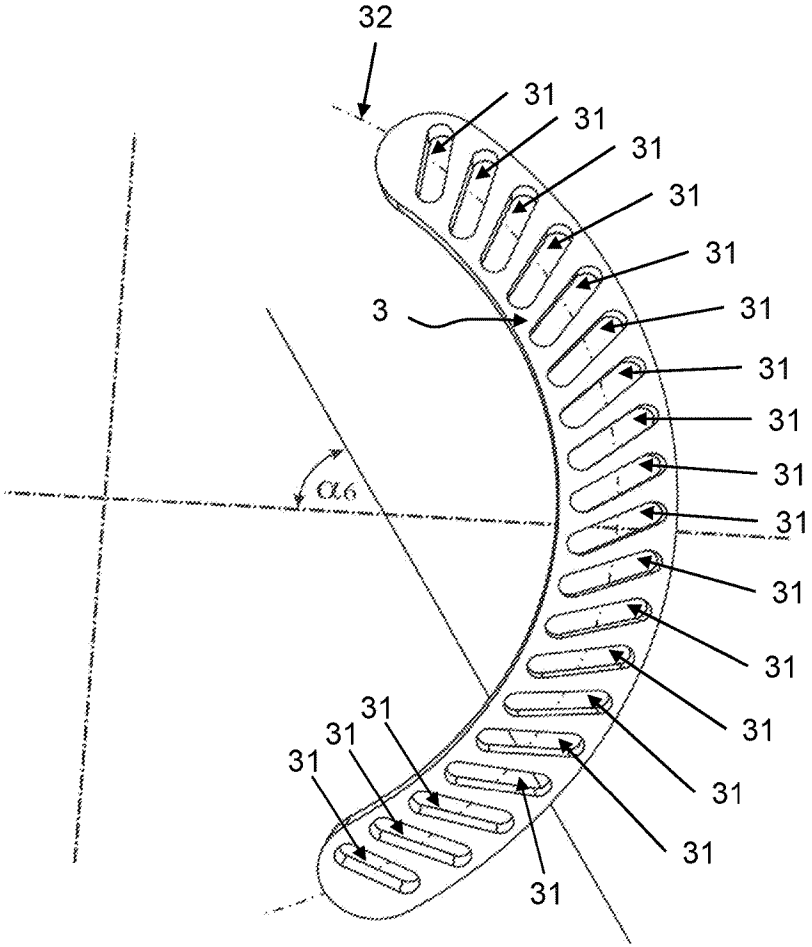

FIGS. 3 and 4 are embodiments of transition pieces, which can be fitted between the premixing chamber and the dispersion compartment. In the simplest case, such transition pieces are welded into the stator head so that they delimit the premixing chamber and separate it from the dispersion compartment. Respecting their width, shape and position in relation to the rotor teeth, such transition pieces be given a geometry that meets specific dispersion requirements and provides for optimum dispersion conditions.

The transition piece in FIG. 3 has slotted holes. $\alpha_6$ is the angle by which the face of a rotor tooth pointing to the front in the direction of rotation is inclined to the rear in relation to the radial (cf. FIG. 12). An arrangement of the slots as shown in FIG. 3, essentially parallel to the front side of a rotor tooth provides for a good penetration depth of the fluid injected from the dispersion compartment and through the transition piece into the premixing chamber. In comparison with other configurations (see FIG. 4), this creates flow conditions in the premixing chamber with relatively few turbulences.

The transition piece shown in FIG. 4 has slotted openings 31 which, in relation to the main direction of expansion 32 of the transition piece 3, are inclined in the opposite direction when compared with the embodiment in FIG. 3. The slots 31 are thus also inclined in relation to the front face 53 of the rotor tooth 5, which is inclined by angle $\alpha_6$ from the radial. This arrangement provides for a good penetration depth of the fluid injected from the dispersion compartment and through the transition piece 3 into the premixing chamber 2, and ejected from the premixing chamber into the dispersion compartment.

At the same time, flow conditions with relatively marked turbulences are produced in comparison with the flow conditions achieved with a transition piece as shown in FIG. 3, because, while passing the front edge of the rotor tooth, fluid is directed into at least two injector slots 31. Thus, different opening cross sections of the slots 31 have to be passed per time unit, which generates pulsating flow conditions in the regions adjacent to the transition piece 3.

Respecting their number, dimensions and shape, the openings 31 can be flexibly designed to meet specific dispersion requirements. With differently designed transition pieces, an inventive stator head can then easily be adjusted to different dispersion requirements. The webs 39 between the slots 31 can, for instance, be given a width which is of a similar dimension as the width of the slots 31, measured in the main direction of expansion 32 of the transition piece 3.

Figure 5:
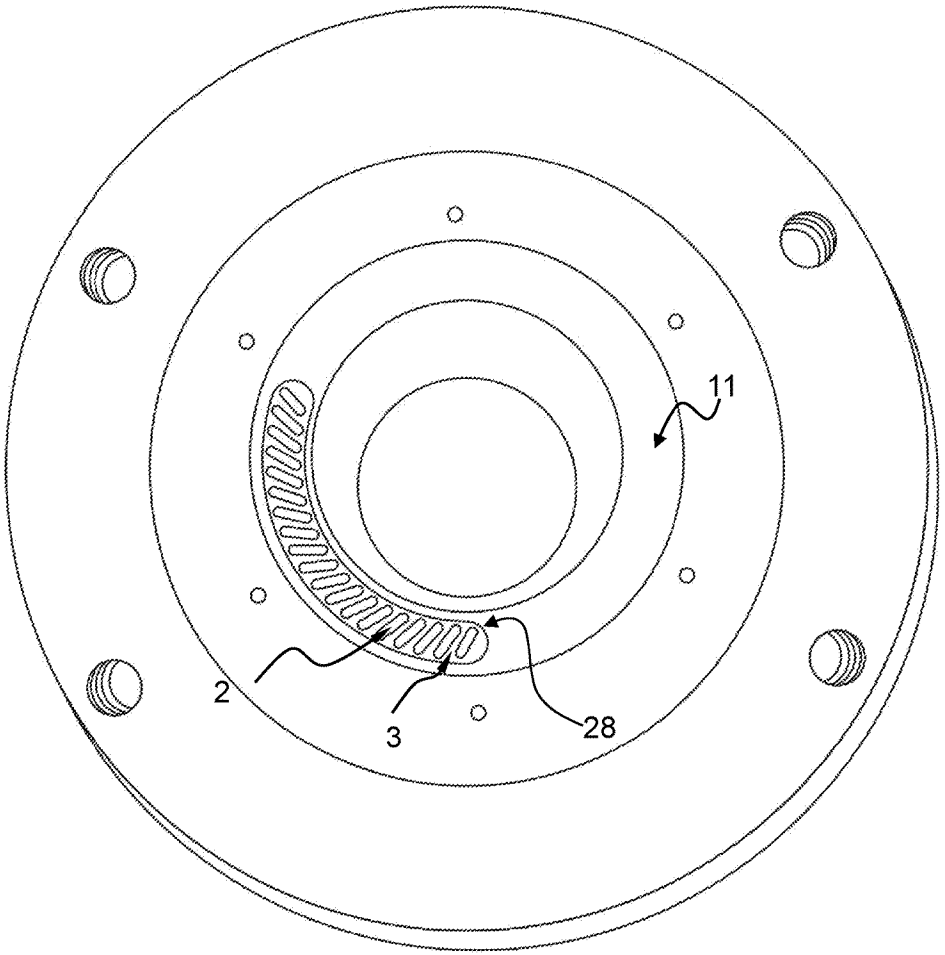

FIG. 5 shows a stator head 11, seen from the dispersion compartment end of the rotor-stator system. In the embodiment shown, the stator head 11 has one premixing chamber 2. The premixing chamber 2 is delimited at its transition to the dispersion compartment by a transition piece 3. The transition piece completely takes up the opening between the premixing chamber 2 and the dispersion compartment. The outer contour of the transition piece 3 essentially matches the curved circumferential line 28 of the transition between the premixing chamber 2 and the dispersion compartment. The embodiment represented in FIG. 5 is not identical with the design version of the invention shown in FIG. 1, as the latter shows an embodiment with two premixing chambers.

The premixing chambers can be defined in their number and the geometry of the injectors/ejectors, their size and their position, as required for the specific process requirements. A dispersion machine with a rated power of 30 kW and a volume for a premixing chamber of approx. 24 cubic meters, can, for instance, have four premixing chambers provided above the inner rotor ring.

With the premixing chambers acting without moving parts, i.e. acting statically, and arranged outside the dispersion compartment, the invention hence allows the system to be adjusted to the product for the specific dispersion requirements. Several components can, in particular, be handled simultaneously, however in a spatially separated manner. Since the stator head can be replaced, several premixing chambers can, for instance, be provided above each rotor ring, as required for specific formulations. In particular for continuous dispersion of different raw materials, the magnitude of the shear and/or expansion forces that are to act on the raw material handled, can thus be varied. If very large volumes of raw materials have to be added, the same raw material can be distributed over several premixing chambers and thus be dosed into the system in a number of individual streams.

The materials, or the components, or the phases of the dispersion, are fed through the premixing chambers with pumps. Pipelines are connected at the intakes 25. Through these pipelines, the components of the dispersion can be supplied, for instance, with dosing pumps, gear-type pumps, or similar conveying elements, from the receiving tanks 102 (cf. FIG. 1) into the premixing chambers.

The percentage of the phase or the phases entering the dispersion compartment through the premixing chambers is determined by the adjustments made on the pumps used and can normally be preset with a frequency converter, which is, for instance, combined with a flow meter.

The size of the premixing chambers and, consequently, the volume available for contact between the phases brought together in the premixing chamber, can also be varied in order to adapt the geometry of the stator head to specific dispersion requirements. By replacing the stator head, which comprises the premixing chambers, the number, position and size of the premixing chambers and of the injectors/ejectors and their arrangement, can quickly be adjusted to specific process requirements.

The number of premixing chambers used is determined by the number of raw materials or components that are to be fed into the system either simultaneously or with some delay. The size of the premixing chambers and/or the geometry of the openings in the transition piece can be selected to match the particle size distribution to be achieved through treatment in the premixing chamber and with the material passage through the transition piece.

It is important for the production of stable dispersions that these parameters are adjusted to the specific dispersion requirements. For instance when producing emulsions, adequate parameter adjustment will prevent high concentrations of newly formed droplets of the disperse phase from occurring in areas with flow conditions that cannot separate the droplets quickly enough from each other, so that they tend to coalesce again after they have been formed.

The curved configuration of the premixing chamber (cf. FIG. 2) provides, on the one hand, for very good mixing of the phases, and, on the other, for easy premixing chamber cleaning. This is achieved by a design without sharp edges and corners where product could get caught or which could favour the formation of dead spots. This also assists essentially complete draining of the rinsing water.

Apart from the options for variation available with the premixing chambers themselves, the configuration of the transition pieces can, in addition, be used to influence the flow conditions created during operation of the rotor-stator system. FIG. 6 shows a number of design options for transition pieces.

FIG. 6*a* is a top view of a transition piece, showing two different geometries for the design of the inlet/outlet ducts 31 as an example. Geometry A10 corresponds to the embodiment of the transition piece shown in FIG. 4. Geometry B10 corresponds to the transition piece geometry shown in FIG. 3.

Apart from the arrangement of the holes or slots 31 in relation to the main direction of expansion 32 of the transition piece 3, the manner in which the holes pass through the thickness of the transition piece at right angles with the plane of the transition piece shown in FIG. 6*a* also plays a role for the influence on the flow conditions in the vicinity of the transition piece.

FIG. 6*b* shows different shapes of ducts for holes passing through transition pieces. A11 depicts straight through-holes. This is the option used in the transition pieces shown in FIGS. 3 and 4. With this geometry A11, the penetration depth of fluid from the dispersion compartment into the premixing chamber is relatively large.

The holes 31 in transition piece 3 are delimited by a lateral area 35. According to design versions B11 and C11, the holes pass through the transition piece at an angle. The hole axis 33 is inclined in relation to the line perpendicular to the transition piece. This inclination is within a range of up to about 45°. According to design versions A12 and B12, the lateral areas 36, 37 of the holes have different partial areas. A first partial area of the lateral area 36 in inclined in relation to the line perpendicular to the transition piece 3. A second partial area 37 of the lateral area is parallel to the line perpendicular to the transition piece 3.

Since the hole axis is inclined in relation to the line perpendicular to the transition piece, geometries B11 and C11 have a lesser penetration depth. On the other hand, this provides for intensified fluid vortexing in the vicinity of the transition piece.

With geometry A12, a large volume of fluid can be conveyed into the premixing chamber. As the holes taper towards the premixing chamber, an injector effect is achieved at the same time, which produces intensive vortices in the premixing chamber. With geometry B12, on the other hand, there is a lesser penetration depth. The following applies as a general rule: if a large volume of material is fed through the intakes 25 into the premixing chambers 2, the fluid supplied through inlet 8 into the dispersion compartment and from there into the premixing chamber 2 is to provide for a large penetration depth into the premixing chamber.

Figure 7:
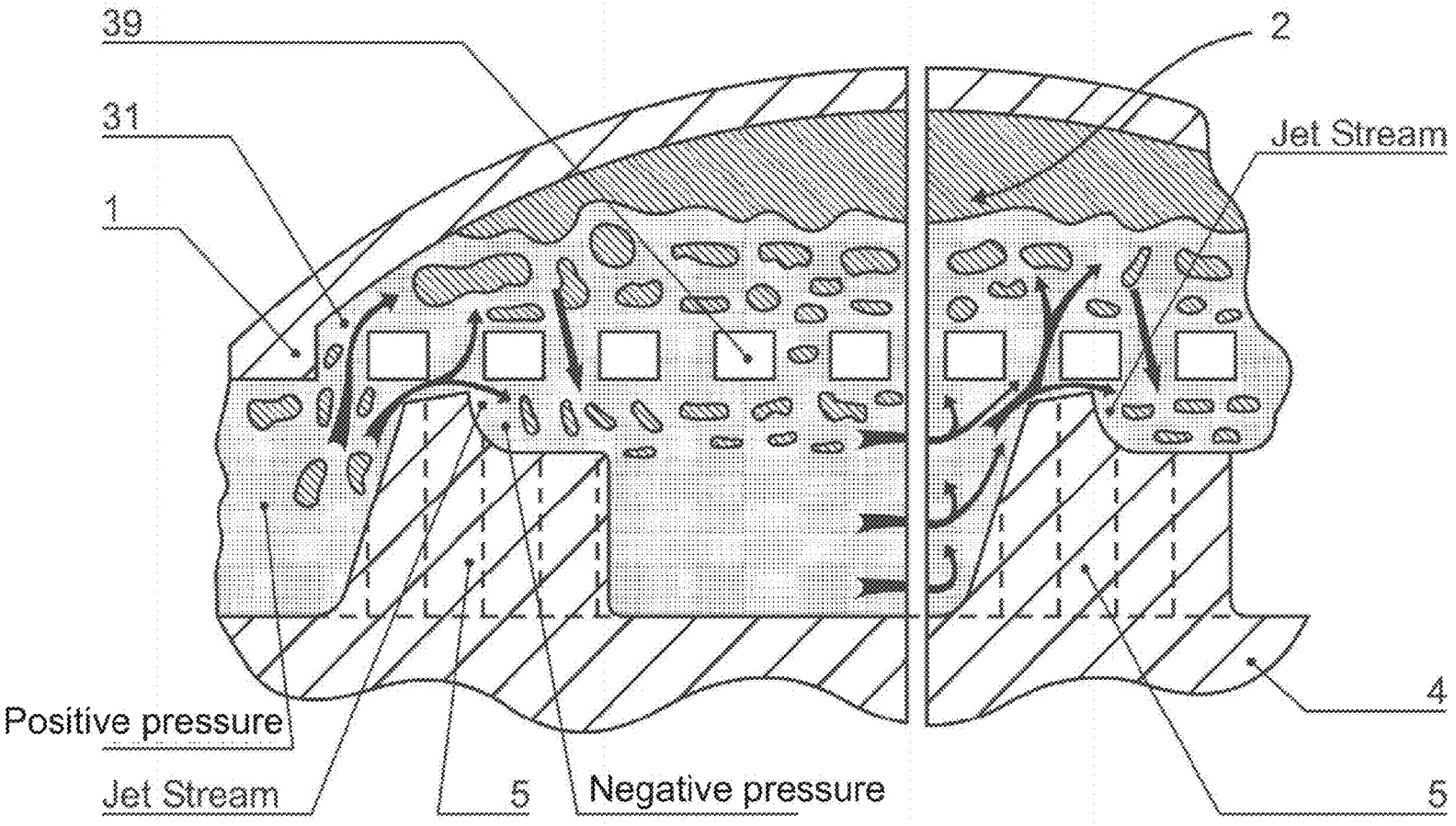
FIG. 7 schematic representation of the fluid to be treated in the production of dispersions as it passes the system, with sectional view of the premixing chamber and the dispersion compartment, FIG. 8 photograph showing a stator from the side, FIG. 9 tooth rings for a stator according to one embodiment (cross-sectional and top view), FIG. 10 photograph of a stator with two premixing chambers and two tooth rings, and of a rotor with one inner and one outer tooth ring, with the rotor and stator forming a rotor-stator system according to one embodiment of the invention, FIG. 11 photograph of a stator with two tooth rings (right) and of a rotor with several obliquely arranged teeth (left) of a conventional rotor-stator system, FIG. 12 a rotor according to one embodiment of the invention (cf.

FIG. 7 is a sectional view of a transition piece in a schematic representation of the fluid flow during operation of the rotor-stator system. The webs 39 of the transition piece, which is arranged at the transition between the premixing chamber 2 and the dispersion compartment formed between the stator 1 and the rotor 4, can clearly be distinguished.

The rotor 4 is provided with rotor teeth 5. As the rotor teeth 5 rotate across the transition piece 3, areas with a high pressure are created in front of the rotor tooth so that fluid is forced from the dispersion compartment and through the ducts 31 into the premixing chamber 2. While the fluid is conveyed past the rotor tooth towards the transition piece and the premixing chamber, jet streams and low pressure areas can be formed as the fluid passes the rotor tooth, the geometry of which will be described in further detail below. With the term "jet stream" reference is made to the meteorological concept used to describe a jet-like flow pattern in which the flow velocity is much higher than around the jet stream.

The schematic representation in FIG. 7 illustrates a simplified model concept which does not claim to completely represent the actual flow conditions.

Figure 8:
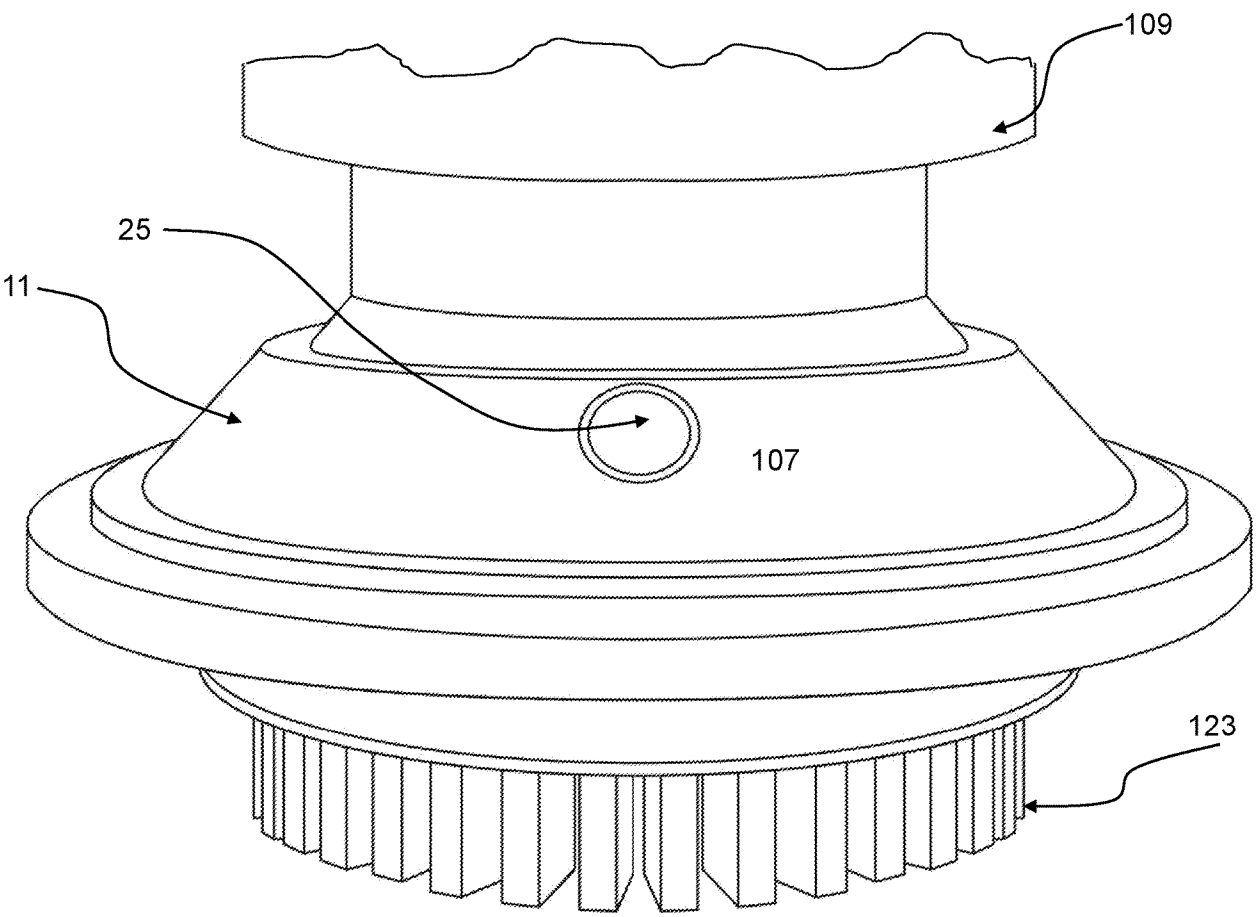

FIG. 8 shows the inventive stator from outside. The stator head 11 has an intake borehole 25, which permits the feed to enter a premixing chamber 2 inside the stator. The stator head 11 is provided with a tooth ring 123. The stator is provided with a quick coupling device 109 with which it can be fitted to the tank 101 (cf. FIG. 1). A feed tube with valve, as shown in FIG. 1, can be connected with the borehole 25. The stator has stator teeth oriented in parallel with its longitudinal axis (running vertically in the illustration).

Figure 9:
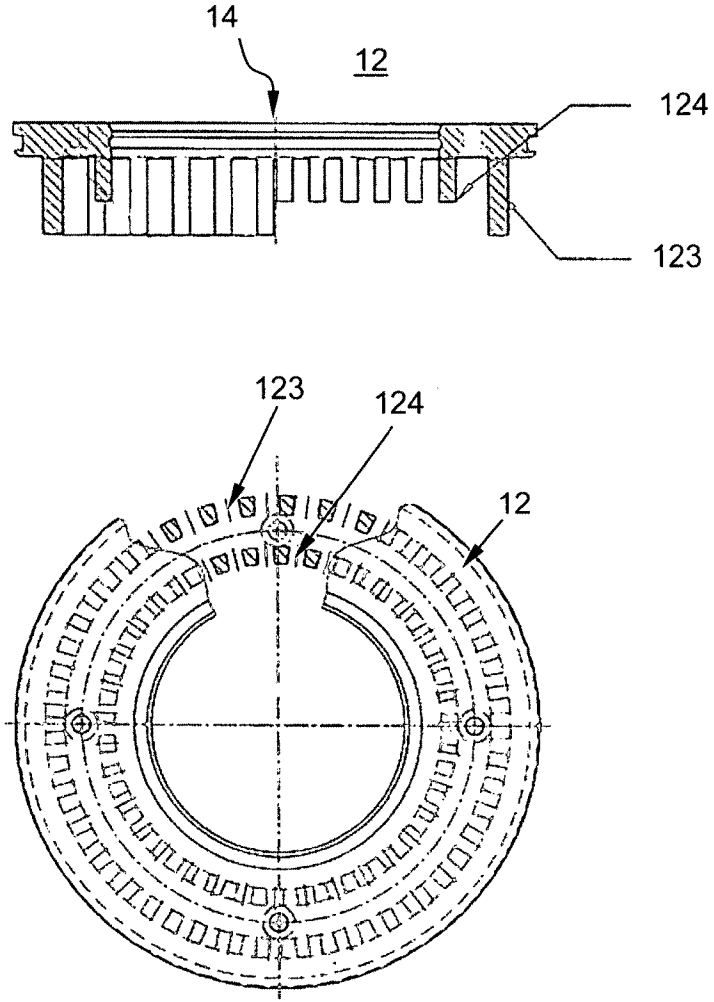

FIG. 9 shows the stator body 12 of a stator with two tooth rings. An inner tooth ring 124 and an outer tooth ring 123 run parallel to the longitudinal axis 14 of the stator body. The teeth of the inner tooth ring have about half the length of the teeth of the outer tooth ring. The stator body is provided with through holes which can be used to fix it with bolts on the stator head.

Figure 10:
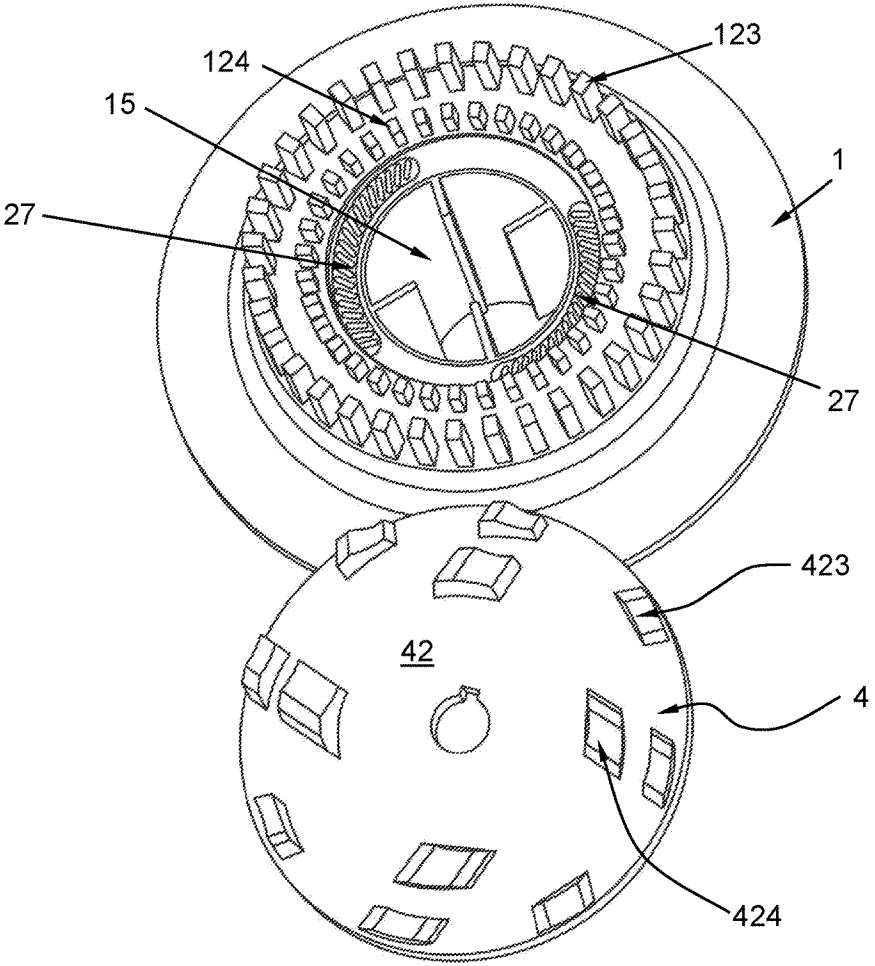
FIG. 10, bottom) as a cross-sectional and top view (left in FIG. 12), with an enlarged detail of a rotor tooth as a cross-sectional view (top right in FIG. 12), FIG. 13 a rotor according to another embodiment of the invention (cf.

FIG. 10 shows an embodiment of the inventive rotor-stator system. Shown at the top is the stator 1. The stator 1 has an inner and an outer tooth ring 123, 124. At its centre, the stator 1 has an inlet 15 through which, downstream of inlet 8, fluid can pass from the receiving tank 101 (cf. FIG. 1) into the dispersion zone. Inside the stator 1 there are two premixing chambers 2, whose transition 27 to the dispersion zone is fitted with slotted transition pieces 3.

The stator 1 forms, together with a rotor, a rotor-stator system in accordance with the invention. There is a gap between the rotor and the stator, as seen in a radial direction from the axis of rotation of the rotor. The width of this gap is between about 0.1 mm to about 1.5 mm. The width of the gap is adjusted to the specific dispersion requirements.

If premixing chambers are provided both above the inner rotor tooth ring and above rotor tooth rings positioned further to the outside, in order to apply media with a relatively high viscosity on the inside and media with a relatively low viscosity on the outside for one single pass through the rotor-stator system, the gap width of, for instance, 0.35 mm can be increased to 0.8 mm when adding the media through premixing chambers equally distanced from the central axis, in order to produce larger droplets.

Such a rotor of the inventive rotor-stator system can, for instance, be designed as shown at the bottom of FIG. 10. According to one embodiment of the invention, this rotor 4 has a carrier plate 42, which carries an inner tooth ring 424 and an outer tooth ring 423. When seen from above, the teeth 5 are parallelogram-shaped. It should be noted that the functionality of the inventive premixing chambers is not limited to such a defined tooth geometry. The invention of a stator with internal premixing chambers can, on the contrary, work with any tooth geometries and rotors that are apt to build up a pressure directed against the premixing chamber from the dispersion compartment.

Figure 11:
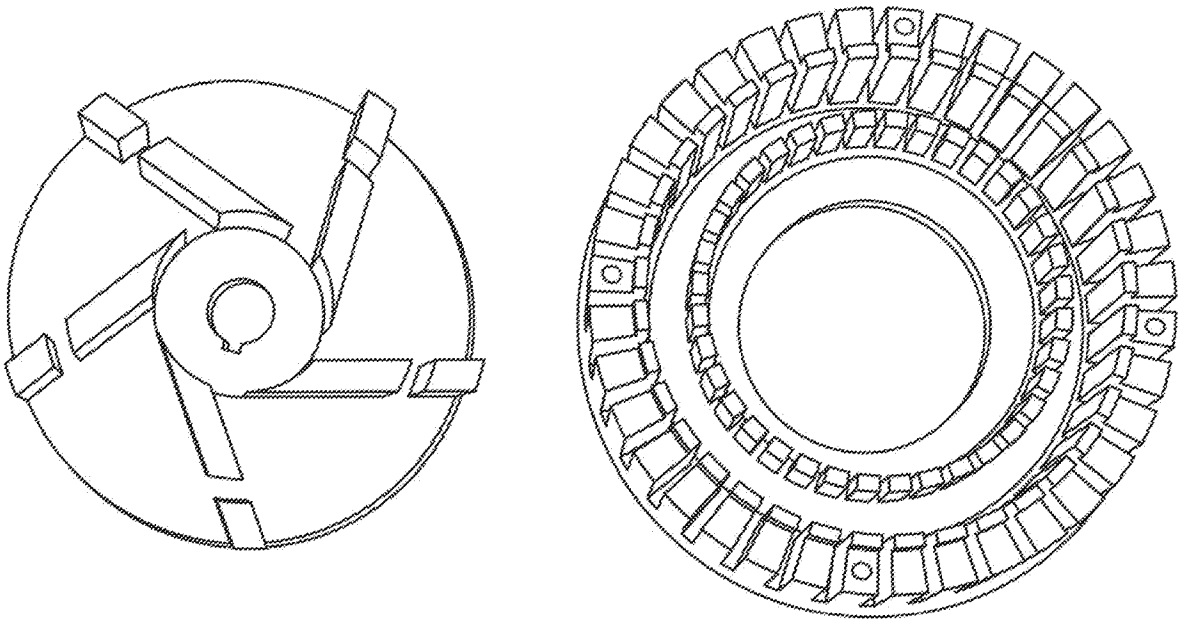

FIG. 11 shows a rotor and a stator of a conventional rotor-stator system for comparison. In comparison with the invention, there are distinct differences in design of the stator (FIG. 11, right), which does not incorporate any premixing chambers, and of the rotor (FIG. 11, left), which carries by far more teeth, which are, however, not arranged to form tooth rings and differ in their orientation to a radial line from the axis of rotation of the rotor.

FIGS. 12 to 16 show, for different embodiments of the invention, the geometry of the rotor and, in particular, of the rotor teeth 5. The rotor 4 has a carrier disk 42 with a through-hole arranged coaxially with the axis of rotation 14 of the rotor. This through-hole serves to connect the rotor 4 with the drive shaft 115 for connection with the motor 116 (cf. FIG. 1). The carrier disk 42 of the rotor 4 carries rotor teeth 5.

The outside dimensions of the rotor and the height of the rotor teeth are, in accordance with the invention, selected to match the rated power of the motor and thus the rated performance of the rotor-stator system. The table below uses examples to provide an overview of suitable combinations of the specified parameters.

| Outside diameter of the rotor in mm | Rated power of the motor in kW | Height of rotor teeth in mm |
|---|---|---|
| 50 | 2.2 | 8 to 10 |
| 75 | 5.5 | 10 to 12 |
| 100 | 11 | 12 to 18 |
| 150 | 22 | 18 to 24 |
| 175 | 30 to 45 | 24 to 32 |
| 285 | 55 to 75 | 24 to 40 |

Rotor-stator systems can be designed as single- or multi-stage systems; the example shown is a two-stage dispersion machine. This machine is a rotor-stator system with two rotor tooth rings, an inner and an outer tooth ring. The inner tooth ring 424 has 4 rotor teeth. The outer tooth ring 423 has eight rotor teeth. This 1-to-2 ratio has been chosen to ensure that there is a continuous build-up of pressure in the machine from the inside to the outside. The same results will be produced with another ratio, for instance a ratio of 1 to 3.

Figure 12:
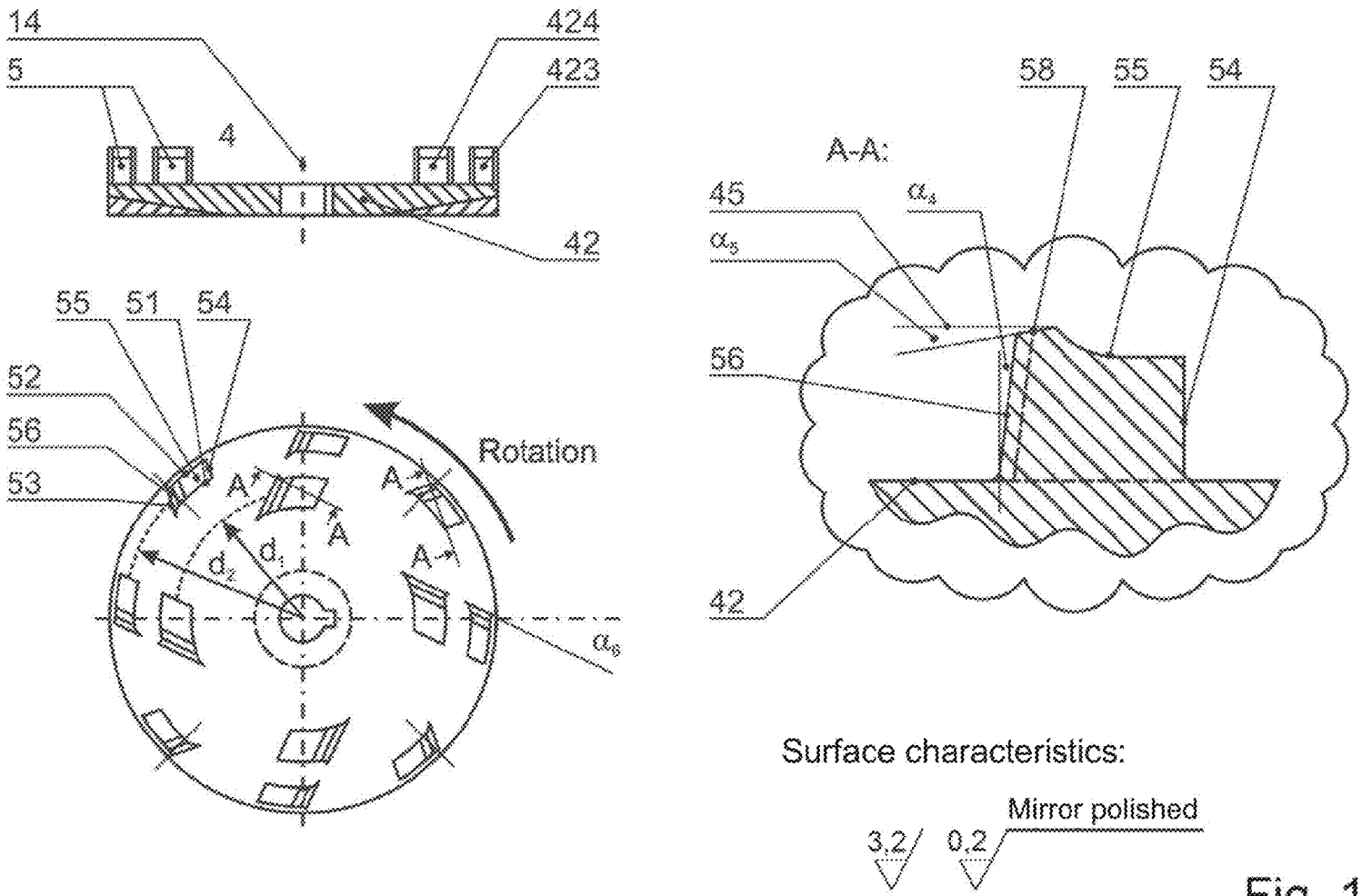
Figure 13:
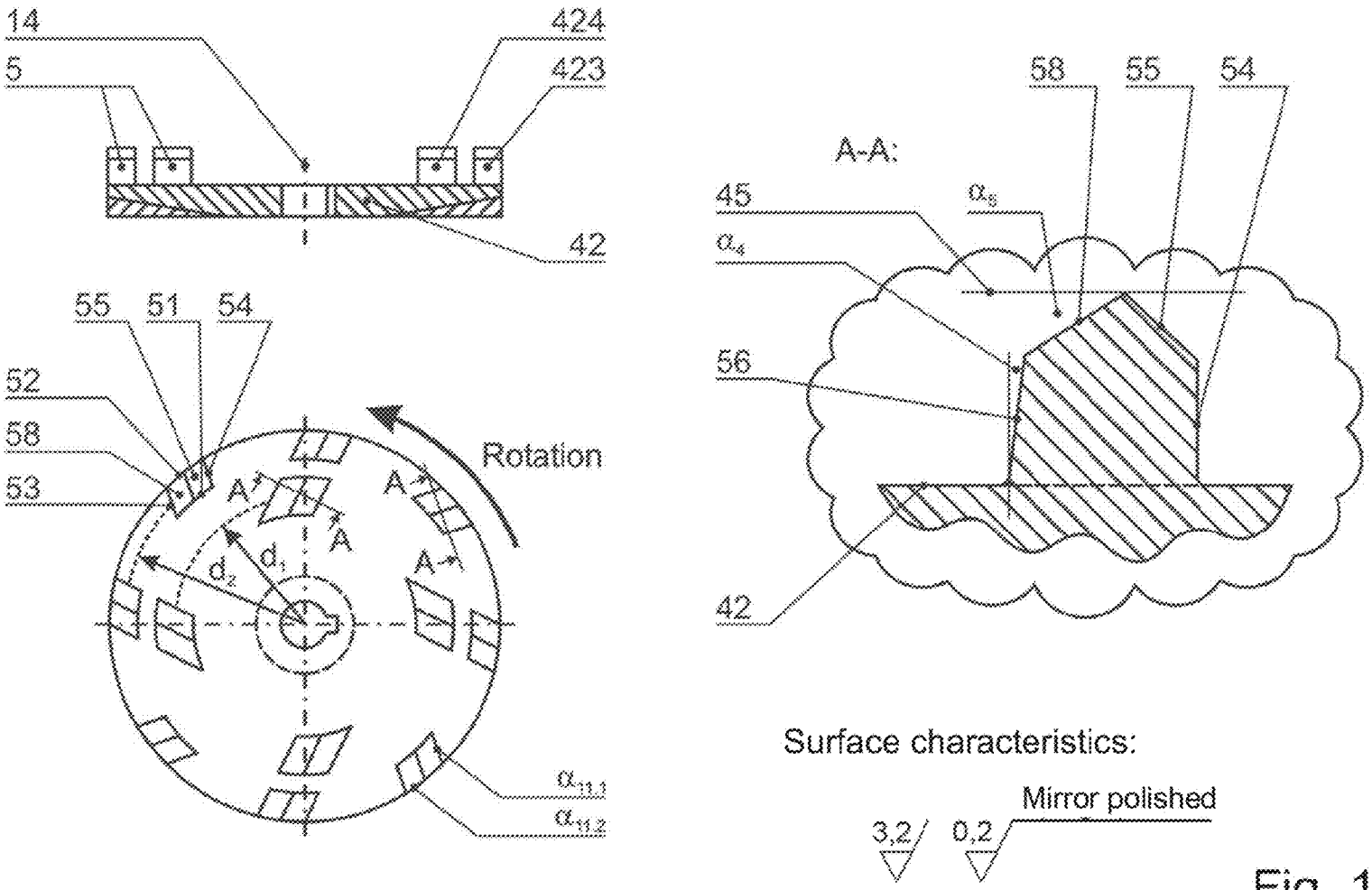
Figure 14:
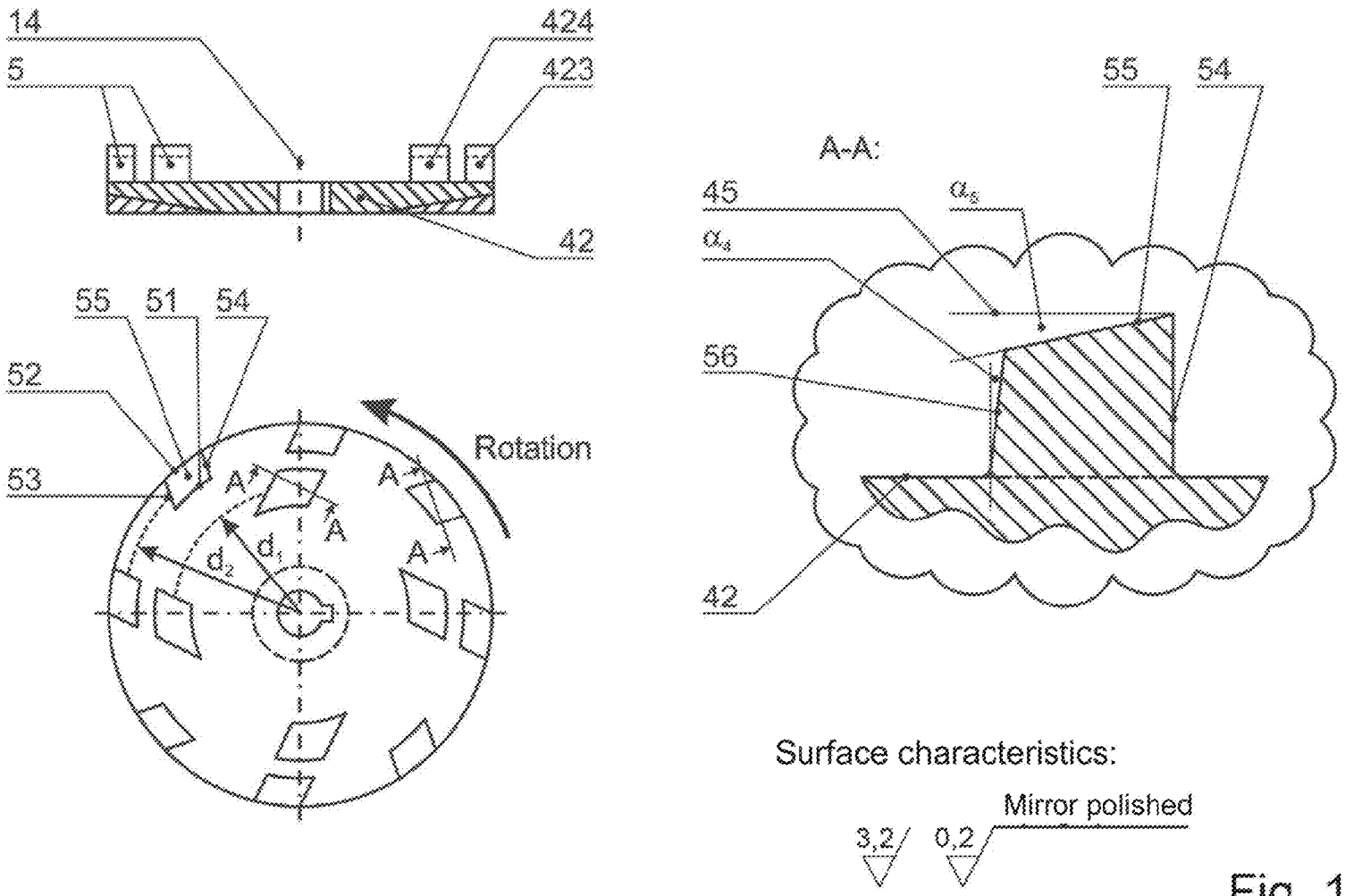
Figure 15:
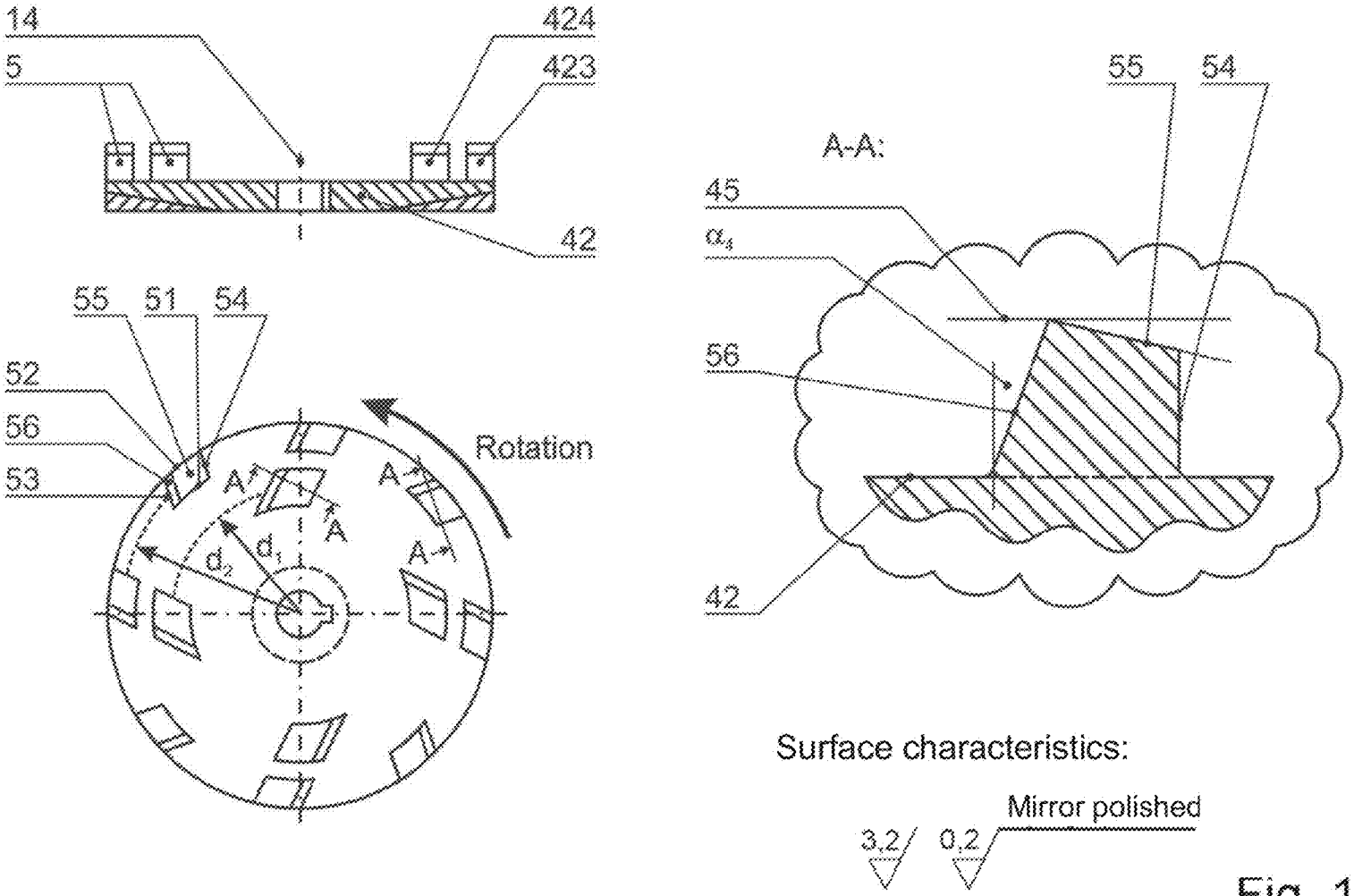
Figure 16:
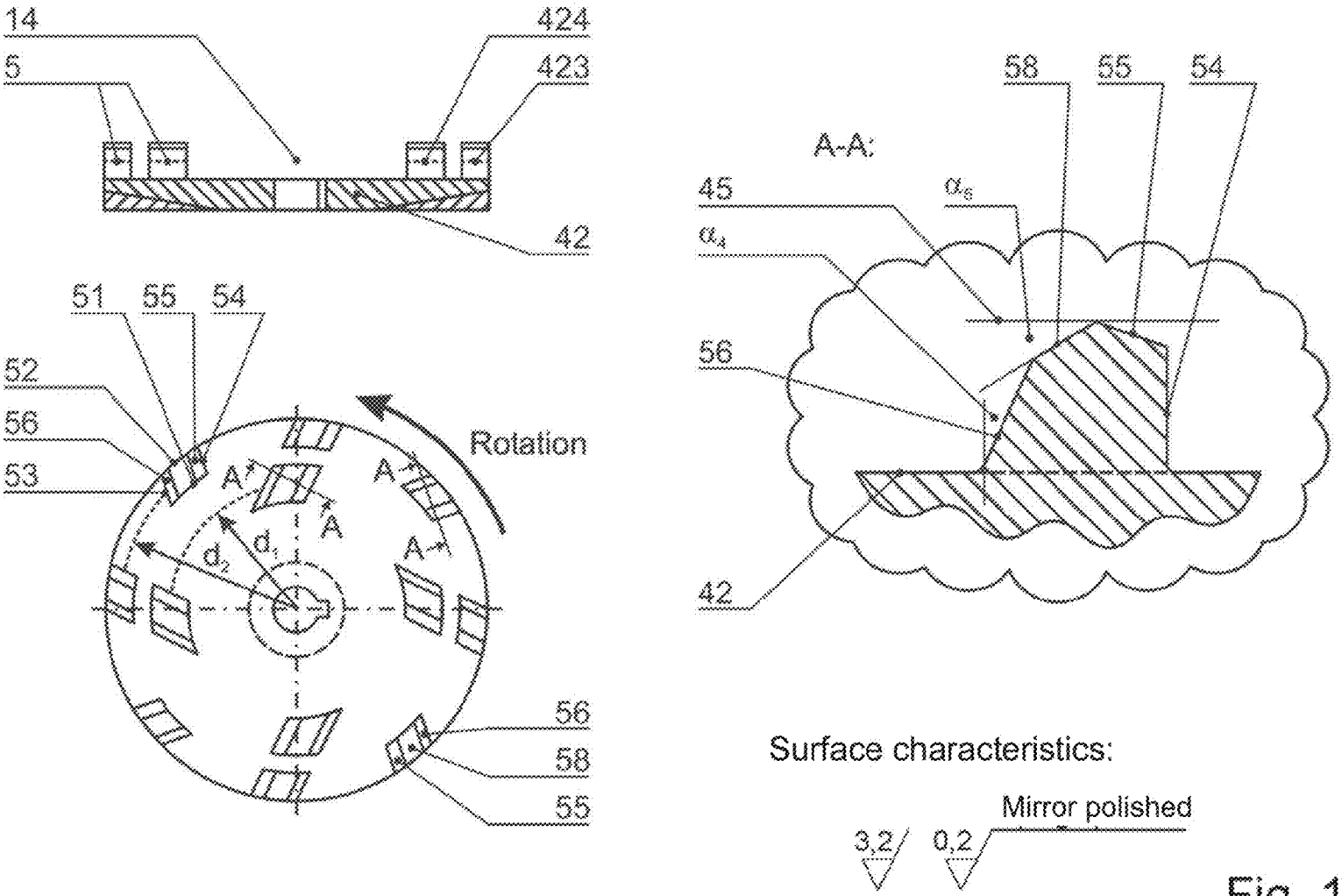

The rotor teeth of the inner tooth ring 424 have a width, which, when measured in a radial direction from the axis of rotation 14, is about twice the width of the rotor teeth in the outer tooth ring 423 (see FIG. 12, top left).

A rotor tooth 5 has an inner side 51 facing the central axis 14 of the rotor, and an outer side 52 facing the outer rim of the carrier disk 42. The front side 53 of the rotor 4 faces the front end, as seen in the direction of rotation of the rotor. The rear side 54 of the rotor tooth is on the rear as seen in the direction of rotation of the rotor. On the side facing away from the carrier disk 42, a rotor tooth is delimited by the top side 55 of the rotor tooth. The rotor teeth of the inner tooth ring are spaced at a distance $d_1$ as seen from the central axis 14 of the rotor, which is smaller than the distance $d_2$ of the rotor teeth in the outer tooth ring 423.

The front side 53 of a rotor tooth 5 is inclined to the rear from a reference line 57 running radially from the axis of rotation 14 of the rotor by an angle $\alpha_6$, related to the direction of rotation of the rotor. In the embodiments shown, the rear side 54 of the rotor tooth has an orientation which is essentially perpendicular to the carrier disk 42. The rear side of the rotor tooth can, however, also have any other orientation. With the rotor-stator system in operation, the inclination by the angle $\alpha_6$ of the front side of the rotor tooth has a radial acceleration effect on the product while it is treated in the dispersion compartment.

The front side 53 has an area 56, which is inclined to the rear by an angle $\alpha_4$ from the line perpendicular to the carrier disk 42 of the rotor 4. With the rotor-stator system in operation, the displacement of area 56 of the front side 53 by the angle $\alpha_4$ exerts a pressure component on the fluid in the dispersion compartment, which transports the fluid towards the stator head and, in particular, into the premixing chamber. The inclination by angle $\alpha_4$ of the area 56 of the front side of the rotor tooth, in addition, intensifies the degree of turbulent flow while the fluid passes the stator teeth that are essentially cuboid and oriented in parallel with the axis of rotation 14.

While preferably the area 56 of the front side, with an inclination to the rear by angle $\alpha_4$, is arranged in the bottom part of the front side, i.e. is turned towards the carrier disk 42, the rotor tooth 5 of the embodiments shown in FIGS. 12, 13, 14 and 16, has a top area 58 at its front side 53, which is inclined downwards, related to the direction of rotation of the rotor 4, by an angle $\alpha_5$ from a reference line 45 running parallel to the main direction of expansion of the carrier disk 42. The inclination by angle $\alpha_5$ of this top area 58 of the front side 53 of the rotor tooth 5 further intensifies the pressure component of the fluid, which is produced by the inclination a4 of the area 56 of the front side of the rotor tooth 5 and which is oriented away from the carrier disk 42. This favours the formation of jet streams in the corresponding areas in the vicinity of area 58 of the rotor tooth 5 in the dispersion compartment when the rotor-stator system is in operation.

According to the model concept, the jet stream is particularly marked at points at which the rotor teeth pass areas of the stator head that do not communicate with a premixing chamber. Because of the multi-part design of the front side 53 with areas 56 and 58, which are inclined by angle $\alpha_4$ and $\alpha_5$, respectively, the rotor tooth provides an additional dispersion edge. The additional dispersion edge intensifies the dispersion efficiency in comparison with a rotor tooth providing only one edge in the zone where the front side merges with the top side of the rotor tooth.

The top side 55 of the rotor tooth 5 extends between the top limitation of the rear side 54 of the rotor tooth, which faces away from the carrier disk 42, and the top limitation of the top area 58 of the front side 53 of the rotor tooth. According to the embodiments of the invention shown in FIGS. 12, 13 15, and 16, the top side 55 is reduced in height between its forward end in the direction of rotation of the rotor at the top end of area 58, and its rear end where it merges with the rear side 54 of the rotor tooth. The detail at the top right of FIG. 12 depicts such a curved contour of the top side 55 of the rotor tooth 5, which can, for instance, be produced by milling. The considered depth of the milled area in relation to line 45 is a measure of the extent to which fluid can be extracted from the premixing chamber into the dispersion compartment, when the rotor tooth 5 passes the transition between the premixing chamber and the dispersion compartment, when the rotor-stator system is in operation. Instead of the curved contour line in the longitudinal section (see FIG. 12) produced by milling, the line can also be a straight oblique line (see FIGS. 13, 15 and 16).

With respect to rotor tooth design, the invention offers a number of possibilities for influencing the flow conditions in the dispersion compartment during operation of the rotor-stator system by specific shapes, thus, in particular, providing the conditions for intensified turbulence in comparison with conventional configurations (see FIG. 11). All the examples shown in FIGS. 12 to 17 meet these requirements and provide, with the slopes in the rotor tooth that can be distinguished in the longitudinal section, at least one additional dispersion edge in comparison with essentially cuboid rotor teeth, in that the inventive rotor teeth feature a jagged surface.

With the configuration as describe above, the rotor teeth are designed to produce both a radial direction of flow through the dispersion compartment, which is, in particular, the result of angle $\alpha_6$, and an axial pressure component oriented towards the stator, in this case from the dispersion compartment into the premixing chamber, which is, in particular, the result of angle $\alpha_4$. As a rotor tooth passes the transition between the premixing chamber and the dispersion compartment, high and low pressure is produced very quickly, for instance within a period of milliseconds, at each rotor tooth, which is transmitted to the fluid in the premixing chamber, and thus provides for intensive intermingling of the two phases in the premixing chamber. The dip in the top side 55 of the rotor tooth in relation to the reference line 45, creates a low pressure so that the fluid is at the same time sucked from the premixing chamber into the dispersion compartment.

FIG. 7 is a schematic representation of the model concept for the fluid motion described above. The comminution effect of the rotor-stator system can be adjusted by an expert by selecting the required geometry, in particular by selecting the angle $\alpha_4$ of the rotor tooth, so that it matches the circumferential velocity of the rotor tooth and the throughput through the dispersion machine. Both the angle $\alpha_4$ and the circumferential velocity of the rotor teeth primarily determine the volume of fluid conveyed from the dispersion compartment into the premixing chamber. The larger $\alpha_4$ at the same circumferential velocity, the larger this volume.

The volume of the second component, or of additional components, added through the premixing chambers, primarily depends on the setting selected for the pumps in intake 25. The desired pump setting can, for instance, be defined by combining these pumps with a frequency converter. With a flowmeter installed in intake 25, the volumetric flow rate passed into the dispersion compartment through the intake 25 can be shown on a display.

Figure 17:
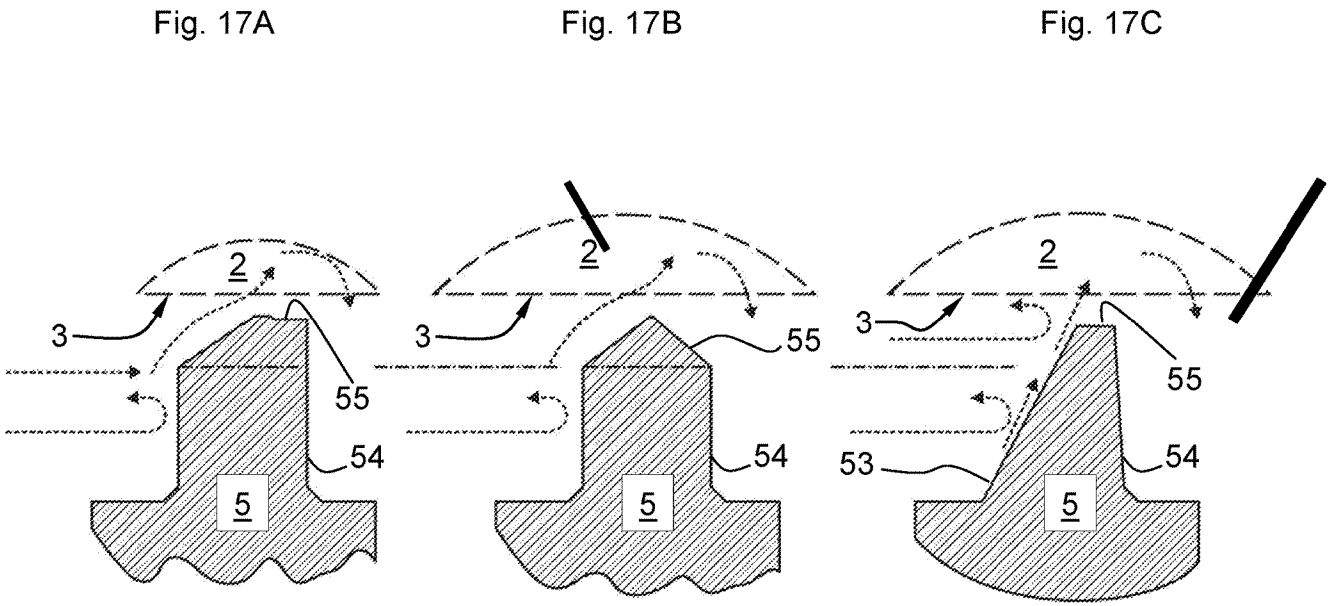

FIG. 17 shows additional versions of the geometry of rotor tooth 5. The rotor tooth 5 in FIG. 17*a* has a front side with a bottom area running vertically in relation to the main direction of expansion of the carrier disk 42, and a top area inclined to the rear in relation to the direction of rotation of the rotor with rotor tooth 5. The top side of the rotor tooth runs parallel to the main direction of expansion of the carrier disk. In FIG. 17*b*, the top side 55 of the rotor tooth 5, has been bevelled in comparison with the design shown in FIG. 17*a*. The embodiment of the rotor tooth in FIG. 17*c* has a sloped front side 53, a top side 55 running parallel to the main direction of expansion of the carrier disk, and a rear side 54, which is inclined towards the front side 53. With said inclination of the rear side 54, the suction effect described above for a dipping top side 55 of the rotor tooth can be intensified.

Figures 18, 18A, 18B:
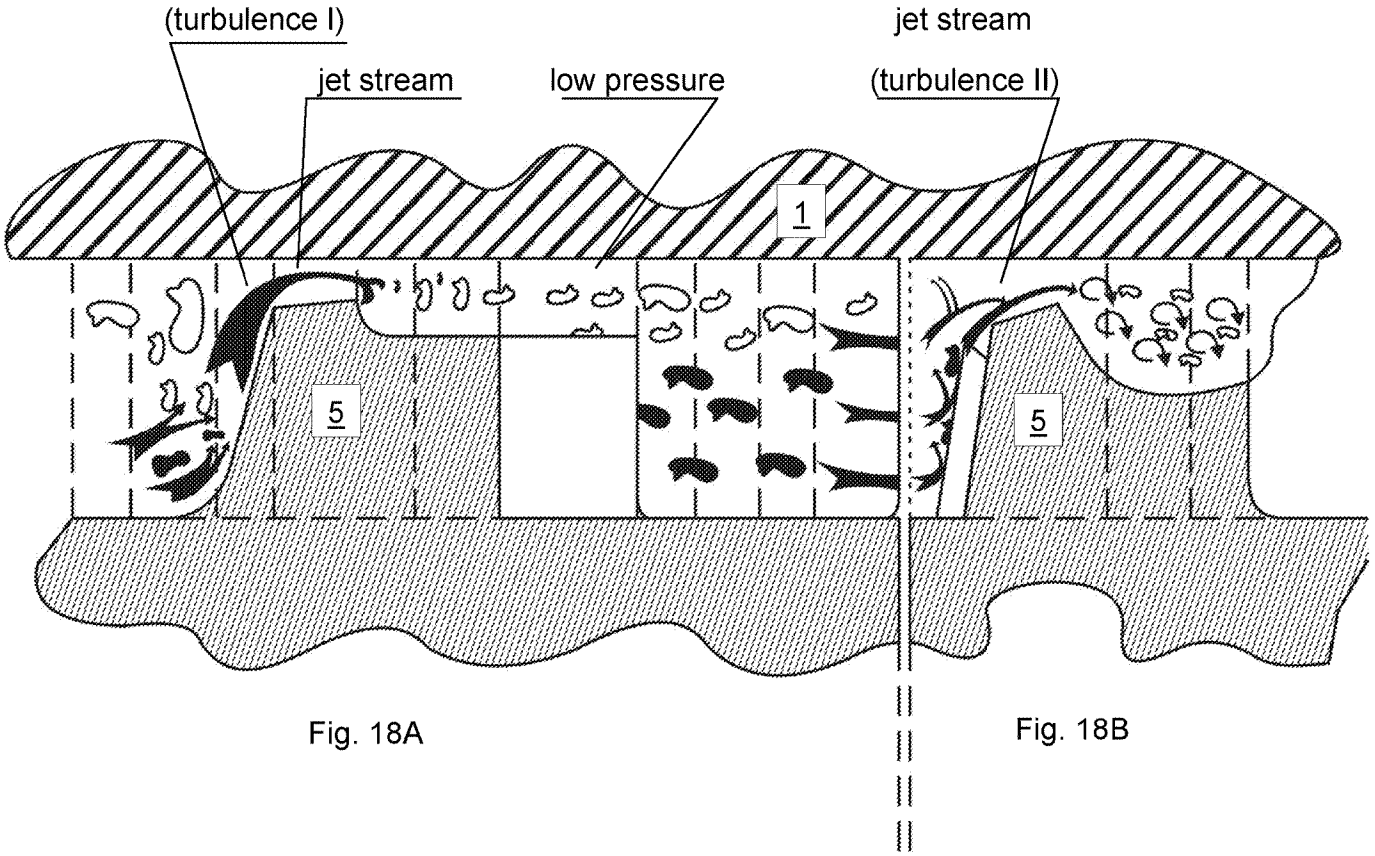

FIG. 18 illustrates a model concept for the effect of different rotor tooth designs on the flow conditions in the vicinity of said rotor teeth during operation of the rotor-stator system. For illustration of the stator 1, a section has been selected that does not have any premixing chambers, in order to direct the attention to the flow conditions in the vicinity of the rotor tooth.

FIG. 14*a* shows a rotor tooth with a plane-milled top side. This configuration is typically used for small to mean component volumes added for dispersion through the intake 25 and the premixing chamber. Small to mean volumes of a component added for dispersion correspond to a percentage of about 5 percent by volume to about 30 percent by volume the this component has in the finished dispersion.

The rotor tooth 5 depicted in FIG. 18*a*, in addition, reveals a smooth transition from the carrier disk 42 of the rotor to the rotor tooth in the bottom area of its front side 53. Owing to this smooth transition at the point where the front side of the rotor tooth originates in the carrier disk, dead spots are reduced to a minimum for the fluid in the dispersion compartment. FIG. 18*b* shows a rotor tooth according to another embodiment of the invention with a very deep dip in the top side 55 of the rotor tooth in comparison with the rotor tooth depicted in FIG. 18*a*. This configuration can be used for mean to large component volumes added for dispersion through the intake 25 and the premixing chambers into the dispersion compartment. Mean to large volumes of a component added for dispersion correspond to a percentage between more than about 30 percent by volume and about 80 percent by volume this component has in the dispersion which is to be produced.

In FIG. 18, the vertical hatched lines running from the stator 1 to the rotor indicate the stator teeth. According to the model concept, micro turbulences, defined as turbulence I in FIG. 18, are created in areas in which a rotor tooth passes such a straight stator tooth. Unlike the jet-stream flow conditions defined as turbulence II, areas in which micro turbulences are created reveal many small high-energy vortices in the fluid of the dispersion compartment.

Figure 19:
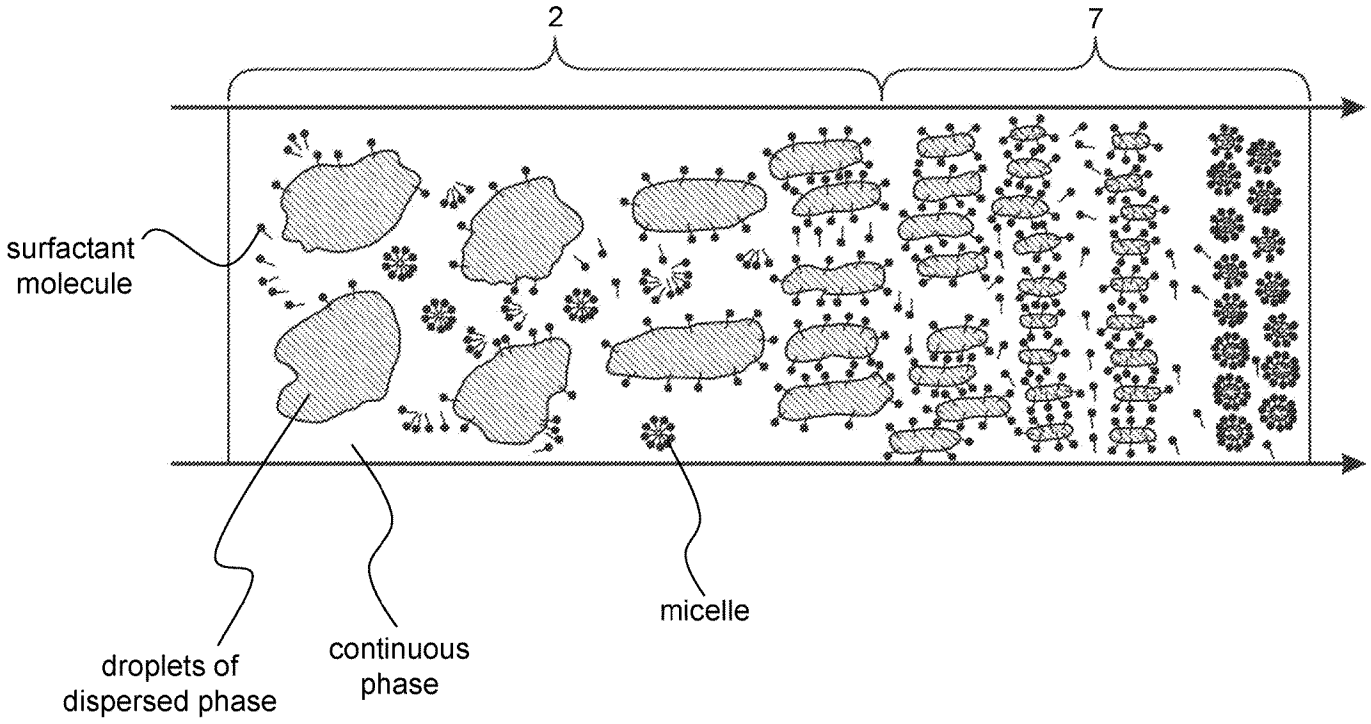

FIG. 19 illustrates a model concept of the production of an emulsion in an inventive rotor-stator system. The region on the left, identified by the number 2, shows an emulsion while passing through the dispersion zone 7. Following treatment in the dispersion compartment, the droplets in the emulsion can further be stabilized while passing through the outlet 9.

After a first contact between the two phases of the emulsion in the premixing chamber (starting on the very left of FIG. 19), the two phases are mixed, and droplets of the disperse phase form in the continuous phase. In the example of the emulsion shown, the disperse phase is a lipophilic phase, and the continuous phase is an aqueous phase. In the continuous phase, emulsifier molecules are dissolved. These are present in the continuous phase in such amounts that, at least at the beginning of the process, micelles partly form from the emulsifier molecules.

As soon as through contact of the disperse phase with the continuous phase an interface has been made available between the lipophilic and the aqueous fluids, the emulsifier molecules start attaching to this interface. While the fluids pass through the premixing chamber, the originally large droplets of the disperse phase are comminuted. At the same time, an increasing number of emulsifier molecules attach to the interface between the disperse and the continuous phases. The process of droplet comminution and interface stabilization by emulsifier molecules continuous in the dispersion compartment 7. Even while the emulsion exiting from the dispersion compartment 7 passes the outlet 9, the process of droplet stabilization assisted by the emulsifier molecules continues.

A detailed model concept was also developed for the process of comminution of the initially large droplets of the disperse phase, in particular when passing through the premixing chamber. Accordingly, deformation and breakup of the droplets takes place, with at least partial involvement of the baker's map (see, for example, Joseph Maria Henri Janssen: Dynamics of Liquid-Liquid Mixing, Chapter 2, Thesis 1993, University of Eindhoven, NL, ISBN 90-386-0402-5).

Figure 20:
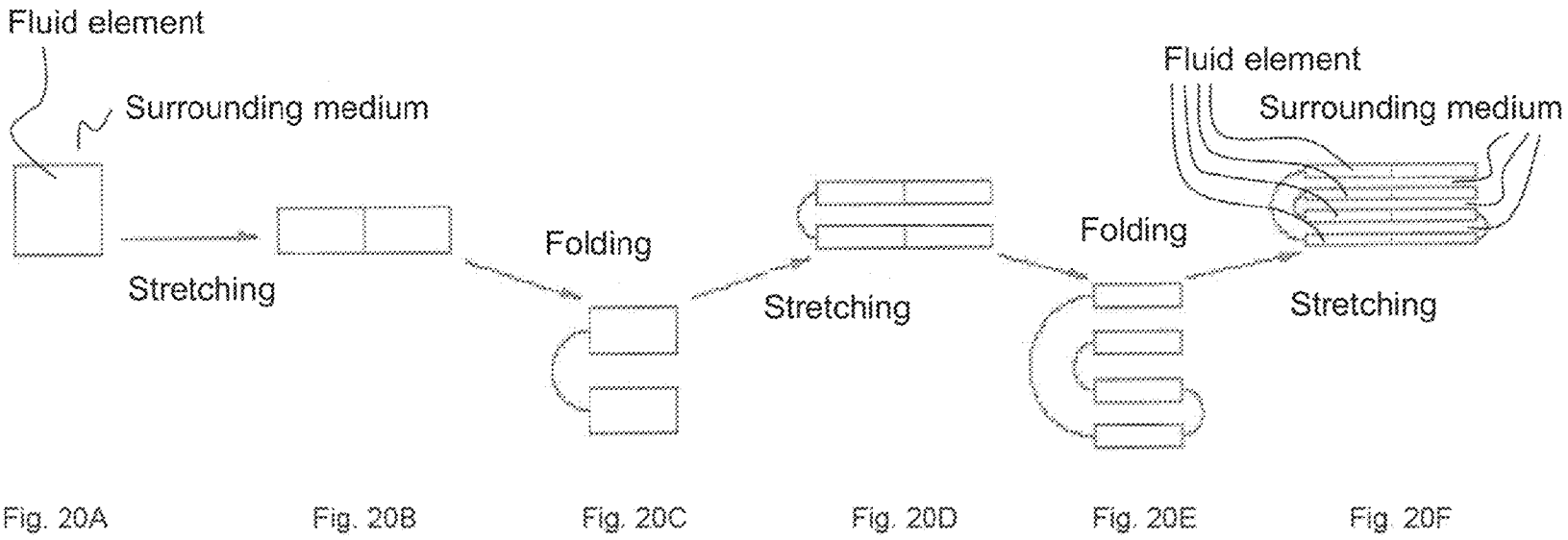

The model concept for the deformation of fluid elements by means of the baker's map is schematically illustrated in FIG. 20. The baker's map was named after the dough kneading process. A dough is pulled to twice its length, then folded over so that the two ends lie one on top of the other. This procedure is repeated until good intermixture has been achieved. Two particles which were originally close together are far apart after a short time.

The representation of the model concept for deformation of fluid elements is based on an observed fluid element in a surrounding medium (FIG. 20A). This fluid element is pulled lengthwise by stretching (FIG. 20B), whereby its height and width correspondingly decrease. The fluid element is then folded (FIG. 20C). After folding, the stretching and folding are continued (FIGS. 20D through 20F), so that the fluid of the observed element and the surrounding medium are intermixed. Using this "baker's map," alternating stretching and folding result in an exponential improvement in the mixing.

Figure 21:
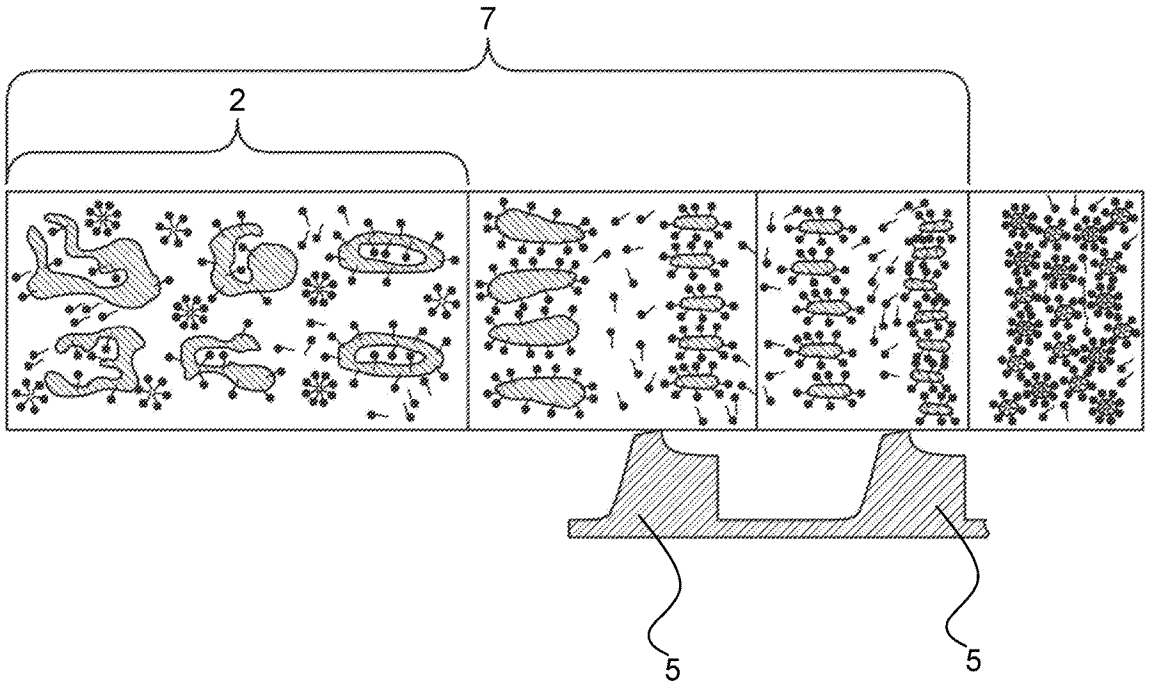
FIG. 21 schematic representation of a model concept for droplet breakup, using the so-called "baker's map" during a single cycle through an inventive rotor-stator system, FIG. 22 schematic representation of a premixing chamber according to another embodiment of the invention, which can be welded into a pump housing, FIG. 23 schematic representation of the front view of a pump with pump housing, accommodating a premixing chamber (cf.

FIG. 21 once again illustrates the intermixing of the continuous phase and the disperse phase, with formation of droplets in the premixing chamber, specifically, in comparison to the illustration in FIG. 19, taking the bakers map into account. This results in schlieren up to the blowing of the disperse phase which forms the droplets, which are then broken up into smaller droplets in the dispersion compartment 7 while passing through the first and second tooth rings of the rotor 5. The circumferential velocity, and therefore in particular the shear rate, continuously increase as the fluid passes from the premixing chamber and through the inner rotor ring and the outer rotor ring until the maximum is reached, thus promoting the controlled breakup of the droplets. This is followed by turbulent stabilization in the outlet duct and the circulation line.

This intensive mixing of the disperse phase and the continuous phase in the premixing chamber is facilitated by the interaction with the inventive rotors when the outer phase is forced into the premixing chamber in the manner of an injector by the axial component of the flow direction at the rotor teeth. The resulting jet cuts the disperse phase into schlieren, which are folded by the abrupt change in direction (negative pressure). The principle may be related to the kneading of a pizza dough, in which the outer phase is embedded in the schlieren. The key factor for the pulling and folding of the fluid elements lies in the abrupt change, made possible by the invention, between negative and positive pressure at each opening in the premixing chamber.

One purpose of the premixing chamber is to minimize nonuniform droplet formation prior to the high-energy dispersion in the dispersion compartment. A fine, homogeneous raw emulsion or raw dispersion prevents an over-concentration of droplets (cluster formation), and ensures a fine, homogeneous emulsion or dispersion subsequent to the high-energy zone, in particular for one pass (inline). In contrast, an over-concentration of droplets entails the risk of a phase reversal.

Another purpose of the premixing chamber is to achieve the dispersion process in one pass without the emulsifier completely surrounding the droplets before or during dispersion. Continuous breakup of the droplets is thus achieved although the emulsifier film is not yet complete. This results in higher efficiency of droplet breakup and smaller droplets, and is particularly important for material systems having great differences in viscosity between the disperse and the continuous phase.

Figure 22:
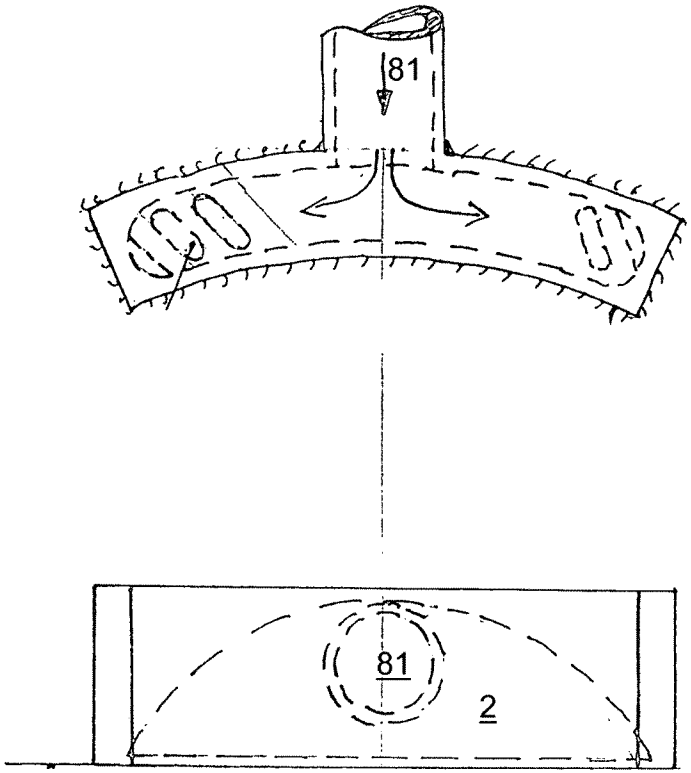
FIG. 22).

The invention of a premixing chamber described above cannot only be employed in stators for rotor-stator systems of dispersion machines, but also in pumps, stirrers and similar apparatus, in which a number of at least partly liquid components are to be mixed with each other. FIG. 22 is a schematic representation of a premixing chamber, which can be welded into a pump housing. The premixing chamber will, for instance, be manufactured from a piece of solid stainless steel and its geometry conforms, for instance, with the description given for FIG. 2.

The premixing chamber is arranged on the side of the apparatus where pressure is generated. The high pressure produced by the moving part, which could be the rotor or the stirrer or the moving pump element, the conveyed component of the dispersion is forced into the premixing chamber. Because of changes between high and low pressure resulting from the motion of the dispersion element, or the moving pump element, the premix, which is becoming increasingly homogenized, is forced or sucked from the premixing chamber.

Highly viscous products can be subjected to a secondary mixing process after they have passed a pump equipped with a premixing chamber. For this purpose, static mixers or stirred tanks or similar arrangements can be used.

Components are fed into the premixing chambers through feed pipes similar to the intakes 25 in FIG. 1. With pumps, such as displacement pumps, the raw materials are pumped into the premixing chambers.

Figure 23:
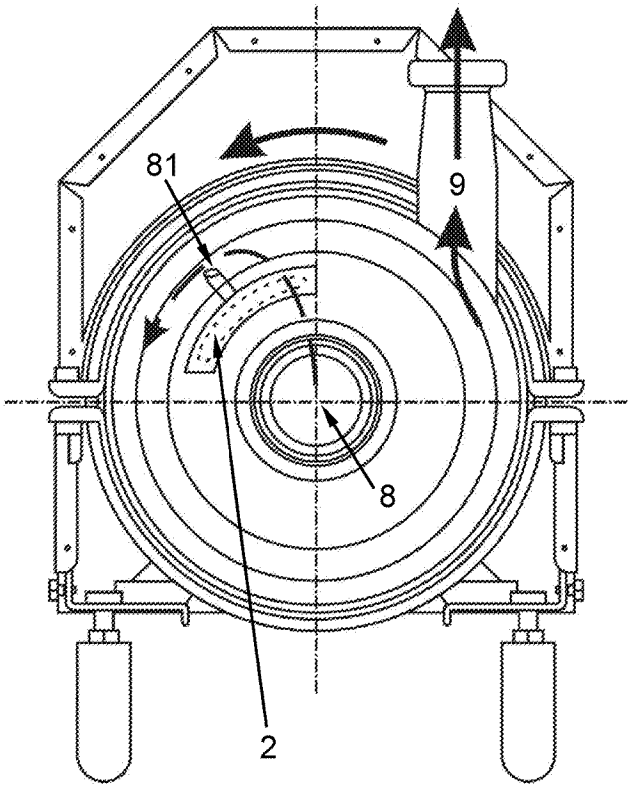

FIG. 23 is a front view of a pump equipped with a premixing chamber inside the pump housing. The pump has an inlet 8 for one fluid and another inlet 81 for another fluid, through which same is fed into the premixing chamber 2. Through an outlet 9, the mixture formed from the fluids is discharged from the pump. In the illustration in FIG. 23, the premixing chamber is positioned to the left of the pump outlet 9. The sense of rotation of the moving pump component is anticlockwise in the plane of the illustration. The pump impellers can be designed as standard pump impellers, such as those of centrifugal pumps, and they have the function of the rotor in the description given above for rotor-stator systems.

Example 1

A dispersion machine with a rotor and a stator according to the invention has a rated output of 30 kW. The rotor has an outside diameter of about 175 mm. The stator provides four premixing chambers that are arranged above the inner ring of the two tooth rings of the rotor. The premixing chambers have a length of about 10 cm each, measured along the main direction of expansion of the premixing chambers. Their width vertically to the main direction of expansion is about 1.2 cm. Their mean depth is about 2 cm, measured between the transition area extending from the premixing chamber into the dispersion compartment, and the inside of the stator. Each chamber provides a volume of about 24 cubic centimeters.

It is assumed that this volume is swept by each rotor tooth passing the premixing chamber during operation of the rotor-stator system. At 3,000 revolutions/minute and four teeth in the inner tooth ring, this means a throughput of 288,000 cubic centimeters per minute or 0.288 cubic meters per minute or 17.3 cubic meters per hour for each premixing chamber.

At a concentration ratio of 40% by volume between the (in the case of an emulsion for instance: inner) phase fed through the premixing chambers and the (in the example of an emulsion: outer) phase provided in the dispersion compartment, 7 cubic meters per hour of an inner phase can thus be handled in each premixing chamber. From this follows that with four premixing chambers a volume of 28 cubic meters can be applied every hour. The inventive dispersion machine is thus superior to conventional apparatus.

Example 2

For the dilution of substances with water, in which a transition state is passed, and in which a dispersion-like system consisting of the substance and water is provided, the invention offers additional advantages. An example of such substances are detergents, such as AE3S 70%, LES 70% and similar substances. These raw materials have to be diluted to a volume percentage of less than 30% in water in one single pass through the machine used for dilution, as otherwise a hexagonal phase may form, with a viscosity which is higher by factor 10 than the viscosity of the original raw material.

Conventional machines often have the problem that the substance to be diluted cannot be brought into sufficient contact with water so that local superconcentrations occur in areas in which both phases are brought together. When diluting detergent substances with water, these local superconcentrations produce so-called fish eyes (hexagonal phase) that are difficult to decompose again. The capacity of conventional dispersion machines are hence rather limited when used for diluting detergents substances. With the inventive premixing chamber, by contrast, the special requirements of detergent substance dilution with water can be adequately accounted for, and the capacity can be flexibly adjusted as required.

Highly concentrated detergent substances with 70% by volume of the substance dissolved in water, such as AE3S, LES or the like, arrive in standard containers of about 23,000 kg. The unloading time is about 60 to 90 minutes, and is limited by the container pipe connections and the high viscosity of the product. The detergent substance is stored in intermediate storage tanks and is then continuously diluted to a concentration of 25% by volume of the detergent substance in water. For production, the thus diluted detergent substance is kept available in other storage tanks.

Traditional continuous dilution plants are costly. To keep costs within acceptable limits, the size of the plant is adjusted to meet actual requirements. When the intended applications change, the user is thus restricted by the installed dilution plant.

However, a plant with inventive premixing chambers is in the position to dilute the volume of detergent substance to be added for dilution in a continuous process directly from the container in which the substance arrives. If necessary, a batch process may also be applied in which case a smaller machine with premixing chambers is used. With a dispersion machine according to the invention, 455 kg/minute of water can, for instance, be fed into the stator in a flowmeter-controlled stream so that this volumetric flow rate of water can enter the dispersion compartment.

Through the inlets for the premixing chambers, 255 kg/minute of detergent substance are pumped into the system. Within one pass, the detergent substance is then, in accordance with the invention, diluted to a percentage of 25% by volume. For this application, the commercially available dispersion machine of the applicant, LEXA-MIX LM30, with a rated output of 30 kW can be employed. With conventional dispersion machines, which have a throughput of 25 to 80 kg/minute of dispersion substance, these large raw material volumes cannot be processed, neither in a continuous nor in a batch process.

The invention, in addition, offers the advantage of clearly reducing capital costs. The initial costs of a typical continuous plant for detergent substance dilution come to approx. 180,000 euros in the year 2008. The initial costs of the afore-mentioned LEXA-MIX dispersion machine, by contrast, only come to 50,000 euros in the year 2008.

Example 3

Another application of the invention is the continuous production of HIP emulsions (high-internal-phase emulsions), such as mayonnaise, which have a large inner-phase percentage. In the example considered here, 10,000 kg/h of mayonnaise with a water phase of 20% by volume and an oil phase of 80% by volume are produced. The oil phase is the disperse phase of an oil-in-water emulsion. Water phase and oil phase are fed into the machine at the right flowmeter-controlled proportions, using the intakes to enter the premixing chamber and the stator to enter the dispersion compartment.

If a large volume of oil is to be blended into a relatively small volume of water, a large interface has to be created between the two phases. The inventive dispersion machine with premixing chamber provides for continuous generation of such a large interface, in conjunction with the intended homogeneous distribution of the oil droplets in the water phase. If necessary, a second dispersion machine, connected in series with the first machine, can be used for continuous addition of further substances, such as lemon juice, to the emulsion produced in the first dispersion machine.

The dispersion machine can, in particular, be designed so that it circulates a major volume, for instance three to five times the actual production volume, in a bypass in order to give the product optimal homogeneity.

All pipelines of the dispersion machine can be of the cooled type. However, cooling is normally not necessary, since in a system according to the invention the large throughputs and the short retention times keep heat development within acceptable limits with most products.

Example 4

When introducing water droplets as droplets of a low viscosity into a silicone-based make-up of a much higher viscosity, the droplets of the water phase are to have a mean diameter of about 100 μm (micrometers) so that the moisture of the water phase will suggest a feeling of freshness when the make-up is applied. However, because of the silicone base, the viscosity of the make-up will increase at intensifying shear action (shear thickening). As a result, smaller and smaller water droplets would be produced when applying the make-up. This is an effect that is not intended.

When using a dispersion machine with premixing chambers, the silicone base can, at mean circumferential velocities within a range between about 10 m/sec. and about 20 m/sec., be conveyed into the premixing chamber via a transition piece of design B10 (cf. FIG. 6*a*). The water phase applied through the premixing chamber is distributed in the silicone matrix in the form of droplets and is then gently dispersed. With adequately defined volumetric flow rates entering the dispersion machine, adequate rotor speed and adequate design of the transition piece, uniform distribution and size of the water droplets in the base matrix can be achieved in one single pass.

It will be evident to the expert that the invention is not limited to the design versions described above, but can be varied in many different ways. The features of the different design versions can, moreover, also be combined with each other or be replaced by each other.

LIST OF REFERENCE SYMBOLS

1 Stator
11 Stator head
123 Outer tooth ring of the stator
124 Inner tooth ring of the stator
12 Stator body
14 Longitudinal axis of the stator=axis of rotation of the rotor=central axis of the rotor
15 Inlet, inflow from a receiving tank into the dispersion zone
17 Dispersion zone of the stator
2 Premixing chamber
25 Intake, entrance into the premixing chamber
27 Transition between premixing chamber and dispersion zone
28 Circumferential line of the transition between premixing chamber and dispersion zone
3 Transition piece, ejector, injector
31 Openings, slot, holes in the transition piece
32 Main direction of expansion of the transition piece
33 Hole axis
34 Perpendicular line to the transition piece
35 Lateral area of the opening in the transition piece
36 First partial area of the lateral area
37 Additional partial area of the lateral area
38 Intersecting plane
39 Web
4 Rotor
423 Outer tooth ring of the rotor
424 Inner tooth ring of the rotor
42 Carrier disk of the rotor
45 Line parallel to the main direction of expansion of the carrier disk
5 Rotor tooth
51 Inner side of the rotor tooth
52 Outer side of the rotor tooth
53 Front side of the rotor tooth
54 Rear side of the rotor tooth
55 Top side of the rotor tooth
56 Area of the front side which is inclined to the rear
57 Reference line
58 Top area of the front side
59 Bottom area of the front side
6 Rotor-stator system
7 Dispersion compartment
8 Inlet for a fluid into the dispersion machine or a pump
81 Inlet for another fluid into the dispersion machine or a pump

82 Inlet for another fluid into the dispersion machine or a pump
9 Outlet for a fluid from dispersion machine or a pump
10 Dispersion machine
101 First receiving tank
102 Second receiving tank
109 Quick coupling device for changing the stator head
112 Ring duct, gap between the outermost tooth ring of the stator and the housing of the dispersion machine
113 Housing
115 Drive shaft for the rotor
116 Motor
117 Seal, mechanical seal
118 Seal, 'O' ring, static seal

What is claimed is:

1. A rotor-stator system (6) for the production and/or treatment of dispersions, with:

a toothed stator (1) having a dispersion zone (17), which, with a toothed rotor (4) corresponding with the stator (1) defines a dispersion compartment (7) of the rotor-stator system (6);

a first inlet (15) arranged at a centre of the toothed stator (1), wherein the first inlet (15) is dimensioned and arranged to feed a first component of a dispersion into the dispersion zone (17);

a premixing chamber (2), which is a cavity and is arranged inside of the toothed stator (1) and outside of the dispersion zone (17), wherein the premixing chamber (2) is dimensioned and arranged to open into the dispersion zone (17); and a second inlet (25) arranged on a head (11) of the toothed stator (1), wherein the second inlet (25) is dimensioned and arranged to feed a second component of the dispersion from outside of the toothed stator (1) into the premixing chamber (2);

wherein the dispersion zone (17) and the second inlet (25) are coupled to the premixing chamber (2) in such a way that the first and second components of the dispersion enter the premixing chamber (2), are mixed within the premixing chamber (2), and exit the premixing chamber (2) into the dispersion zone (17) when the rotor-stator system (6) is operated; and wherein a transition piece (3) is arranged between the premixing chamber (2) and the dispersion zone (17) with the transition piece being substantially designed as a perforated plate, and provides one or a plurality of circular and/or polygonous openings, and/or a slot or a plurality of slots as holes (31), with multiple slots being substantially arranged at right angles with a main direction of expansion (32) of the transition piece (3).

2. The rotor-stator system (6) according to claim 1, wherein the toothed stator (1) has at least two premixing chambers (2) arranged inside of the toothed stator (1) and outside of the dispersion zone (17), each providing one intake (25) for feeding a component of the dispersion from outside the toothed stator (1) into the relevant premixing chamber (2).

3. The rotor-stator system (6) according to claim 1, wherein the premixing chamber (2) curves into the toothed stator (1) from a transition to the dispersion zone (17).

4. The rotor-stator system (6) according to claim 1, wherein the premixing chamber (2) has the shape of a strip-like section of a circle segment at a transition to the dispersion zone (17), this section having a continuously curved circumferential line (28).

5. The rotor-stator system (6) according to claim 1, wherein transition of the premixing chamber (2) to the dispersion zone (17) is positioned at such a radial distance from the longitudinal axis (14) of the stator, which is identical with the axis of rotation of the toothed rotor (4) corresponding with the toothed stator (1), that the premixing chamber (2) is positioned above a dispersion tool when the toothed stator (1) is combined with the corresponding toothed rotor (4) to form the rotor-stator system (6).

6. The rotor-stator system (6) according to claim 5, wherein the transition of the premixing chamber (2) to the dispersion zone (17) is positioned at such a radial distance from the longitudinal axis (14) of the toothed stator (1), which is identical with the axis of rotation of the toothed rotor (4) corresponding with the toothed stator (1), that the premixing chamber (2) is positioned at least above the inner dispersion tool of a rotor with more than one dispersion tool, when the toothed stator (1) is combined with the corresponding toothed rotor (4) to form the rotor-stator system (6).

7. The rotor-stator system (6) according to claim 1, wherein the toothed stator (1) has at least two premixing chambers (2) that are positioned at different radial distances from the longitudinal axis (14) of the stator.

8. The rotor-stator system (6) according to claim 1, wherein the transition piece (3) takes up part of, or the complete area of a transition between the premixing chamber (2) and the dispersion zone (17).

9. The rotor-stator system (6) according to claim 1, wherein the transition piece (3) has the shape of a strip-like section of a circle segment.

10. The rotor-stator system (6) according to claim 1, wherein the holes (31) passing through the transition piece (3) are arranged along a hole axis (33), which together with the line perpendicular to the transition piece (3) forms an angle.

11. The rotor-stator system (6) according to claim 1, wherein the holes (31) through the transition piece (3) are delimited by a lateral area (35) with a first partial area (36) and at least one additional partial area (37), at least one partial area (36, 37) running along an intersecting plane which together with the line perpendicular to the transition piece (3) forms an angle.

12. The rotor-stator system (6) according to claim 1, wherein the toothed stator (1) is of the two-part type and comprises as a first part the stator head (11) and as a second part a stator body (12), wherein the premixing chamber (2) is accommodated in the stator head (11), and wherein the stator body (12) is a dispersion tool.

13. The rotor-stator system (6) according to claim 12, wherein multiple stator heads (11), which differ in the number and/or geometry of the premixing chambers (2), can be mounted on a stator body (12) in order to form the toothed stator (1) with replaceable stator head.

14. The rotor-stator system (6) according to claim 1, wherein at least one premixing chamber (2) is designed as a cavity in the toothed stator (1) such that a transition piece (3) can be fitted to the stator so that it delimits the cavity.

15. The rotor-stator system (6) according to claim 13, wherein at least one premixing chamber (2) is designed as a cavity in the stator head (11) such that a transition piece (3) can be fitted to the stator head so that it delimits the cavity.

16. A toothed stator (1) having:

a dispersion zone (17) that defines, along with a toothed rotor (4) corresponding with the toothed stator (1) in a rotor-stator system (6), a dispersion compartment (7), wherein the dispersion zone (17) is fed a first component of a dispersion;

a premixing chamber (2) arranged inside of the toothed stator (1) and outside of the dispersion zone (17), wherein the premixing chamber (2) is dimensioned and arranged to open into the dispersion zone (17); and an inlet (25) arranged on a head (11) of the toothed stator (1), wherein the inlet (25) is dimensioned and arranged to feed a second component of the dispersion from outside of the toothed stator (1) into the premixing chamber (2);

wherein the dispersion zone (17) and the inlet (25) are coupled to the premixing chamber (2) in such a way that the first and second components of the dispersion enter the premixing chamber (2), are mixed within the premixing chamber (2), and exit the premixing chamber (2) into the dispersion zone (17) when the rotor-stator system (6) is operated; and wherein a transition piece (3) is arranged between the premixing chamber (2) and the dispersion zone (17) with the transition piece being substantially designed as a perforated plate, and provides one or a plurality of circular and/or polygonous openings, and/or a slot or a plurality of slots as holes (31), with multiple slots being substantially arranged at right angles with a main direction of expansion (32) of the transition piece (3).

17. A rotor (4) for a rotor-stator system (6) for the production and/or treatment of dispersions with a carrier disk (42) arranged rotationally symmetrically with the central axis (14) of the rotor, with at least one rotor tooth (5) having its source in the carrier disk, the rotor tooth (5) having an inner side (51) facing the central axis (14), an outer side (52) facing the outer rim of the carrier disk (42), a front side (53) positioned at the front end of the rotor (4), a rear side (54) positioned at the rear end of the rotor (4), and a top side (55) delimiting the rotor tooth (5) on the side facing away from the carrier disk (42), wherein the front side (53) comprises at least one bottom area (59) facing the carrier disk (42), the bottom area being inclined to the rear from the line perpendicular to the carrier disk by an angle between 15° and 45° in relation to the direction of rotation of the rotor when in operation, and wherein the front side (53) comprises at least one top area (58) pointing away from the carrier disk (42), which, in relation to the line (45) parallel to the main area of expansion of the carrier disk (42), is inclined towards the carrier disk by an angle between 5° and 45°.

18. The rotor (4) according to claim 17, wherein the front side (53) comprises at least one area (56) which is inclined from a reference line (57) running radially outwards from the central axis (14) by an angle between 0° and 60°, related to the direction of rotation of the rotor when in operation.

19. The rotor (4) according to claim 17, wherein the rotor (4) has a first tooth ring (423) with at least two rotor teeth (5), having a first radial distance $d_1$ from the central axis (14) of the rotor.

20. The rotor (4) according to claim 19, wherein the rotor (4) has a second tooth ring (424) with at least two rotor teeth (5), which have a second radial distance $d_2$ from the central axis (14) of the rotor, $d_2$ being larger than $d_1$.

* * * * *